US010418764B2

(12) United States Patent
Baines et al.

(10) Patent No.: US 10,418,764 B2
(45) Date of Patent: Sep. 17, 2019

(54) PATCH PANEL FRAME FOR CIRCUIT BOARD MODULE

(71) Applicant: Molex, LLC, Lisle, IL (US)

(72) Inventors: Elliot A. Baines, Naperville, IL (US); Gene Schneider, Wheeling, IL (US); Bjarne Frederiksen, Lombard, IL (US); Philip Rivers, Bolingbrook, IL (US); Augusto Panella, Naperville, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/501,359

(22) PCT Filed: Aug. 5, 2015

(86) PCT No.: PCT/US2015/043831
§ 371 (c)(1),
(2) Date: Feb. 2, 2017

(87) PCT Pub. No.: WO2016/022701
PCT Pub. Date: Feb. 11, 2016

(65) Prior Publication Data

US 2017/0229825 A1 Aug. 10, 2017

Related U.S. Application Data

(60) Provisional application No. 62/033,965, filed on Aug. 6, 2014.

(51) Int. Cl.
*H01R 13/514* (2006.01)
*H01R 25/00* (2006.01)
(Continued)

(52) U.S. Cl.
CPC ..... *H01R 25/006* (2013.01); *H01R 13/514* (2013.01); *H01R 13/518* (2013.01);
(Continued)

(58) Field of Classification Search
CPC ..... H01R 13/514; H01R 13/518; H01R 13/6275; H01R 13/665; H01R 13/7175; H01R 25/006
(Continued)

(56) References Cited

U.S. PATENT DOCUMENTS 5,108,294 A 4/1992 Marsh et al.
5,394,503 A 2/1995 Dietz, Jr. et al.
(Continued)

FOREIGN PATENT DOCUMENTS

CN 2432694 Y 5/2001
CN 1551421 A 12/2004
(Continued)

OTHER PUBLICATIONS

International Search Report and Written Opinion received for PCT application No. PCT/US2015/043831, dated Nov. 19, 2015, 17 pages.
(Continued)

*Primary Examiner* — Edwin A. Leon
*Assistant Examiner* — Milagros Jeancharles
(74) *Attorney, Agent, or Firm* — Molex, LLC

(57) ABSTRACT

An improved patch panel assembly includes a frame and faceplate that mate with a housing, and the housing defines a plurality of individual communication ports. The housing is mounted to the patch panel frame and includes jack openings that accommodate data jacks and circuit board openings that accommodate mating blades of circuit boards. The two sets of openings are separated on the housing by an intervening spacing and interposer terminal sets are provided to electrically interconnect the jacks with circuits on the circuit boards. The patch panel housings may be formed in discrete groupings so that, if desired, the patch panels may have ports that are grouped together by bandwidth, storage
(Continued)

capability and the like. Inasmuch as the housings are mounted to the patch panel frames, the jacks and the circuit boards can be easily and individually replaced, repaired or upgraded with similar components without requiring disassembly of the patch panel.

8 Claims, 27 Drawing Sheets

(51) Int. Cl.

| | |
|---|---|
| ***H01R 13/74*** | (2006.01) |
| ***H01R 24/64*** | (2011.01) |
| ***H01R 13/518*** | (2006.01) |
| ***H01R 13/627*** | (2006.01) |
| ***H01R 13/66*** | (2006.01) |
| ***H01R 13/717*** | (2006.01) |
| *H01R 107/00* | (2006.01) |

(52) U.S. Cl.
CPC ..... *H01R 13/6275* (2013.01); *H01R 13/665* (2013.01); *H01R 13/7175* (2013.01); *H01R 13/74* (2013.01); *H01R 24/64* (2013.01); *H01R 2107/00* (2013.01)

(58) Field of Classification Search
USPC ..... 439/344
See application file for complete search history.

(56) References Cited

U.S. PATENT DOCUMENTS 5,764,043 A 6/1998 Czosnowski et al.
5,944,535 A 8/1999 Bullivant et al.
5,944,539 A 8/1999 Ernolf et al.
6,053,764 A 4/2000 Curry et al.
6,074,256 A 6/2000 Arnett
6,079,966 A 6/2000 Bearint et al.
6,168,472 B1 1/2001 Arnett
6,305,987 B1 10/2001 Crane, Jr. et al.
6,364,694 B1 4/2002 Lien
6,535,367 B1 3/2003 Carpenter et al.
6,574,586 B1 6/2003 David et al.
6,590,374 B1 7/2003 Har-Lev
6,626,697 B1 9/2003 Martin et al.
6,750,643 B2 6/2004 Hwang et al.
6,764,343 B2 7/2004 Ferentz
6,840,779 B2 1/2005 Eberle et al.
6,890,197 B2 5/2005 Liebenow
6,916,206 B2 7/2005 Ferentz
6,953,362 B2 10/2005 Mossner et al.
7,038,918 B2 5/2006 AbuGhazaleh et al.
7,040,926 B2 5/2006 Ferentz
7,053,598 B2 5/2006 Shieh et al.
7,179,131 B2 * 2/2007 Caveney ..... H05K 1/0228 307/147
7,186,149 B2 * 3/2007 Hashim ..... H05K 1/0228 439/344
7,207,846 B2 * 4/2007 Caveney ..... H01R 29/00 439/676
7,209,963 B2 4/2007 Burton et al.
7,234,944 B2 6/2007 Nordin et al.
7,240,364 B1 7/2007 Branscomb et al.
7,266,818 B2 9/2007 Pike et al.
7,314,392 B2 1/2008 Pharn et al.
7,367,852 B2 5/2008 Niggemann et al.
7,384,300 B1 6/2008 Salgado et al.
7,458,856 B2 12/2008 Ferentz
7,563,102 B2 7/2009 Nordin et al.
7,591,667 B2 9/2009 Gatnau Navarro et al.
7,722,370 B2 5/2010 Chin
7,722,402 B2 5/2010 Pepe et al.
7,854,624 B1 * 12/2010 Pepe ..... H01R 13/518 439/489
7,909,622 B2 * 3/2011 Pepe ..... H01R 13/516 439/607.02
8,033,873 B2 10/2011 Ankerstjerne
8,203,450 B2 6/2012 German et al.
8,251,707 B2 8/2012 Panella et al.
8,376,787 B2 2/2013 Panella et al.
8,562,358 B2 10/2013 Panella et al.
8,641,452 B2 2/2014 Patel et al.
8,708,724 B2 4/2014 Patel et al.
8,753,142 B2 6/2014 Fariello et al.
8,781,284 B2 7/2014 Bragg
2001/0004567 A1 * 6/2001 Chen ..... H01R 13/514 439/607.01
2002/0019174 A1 2/2002 Crane, Jr. et al.
2003/0054699 A1 * 3/2003 Sato ..... H01R 13/64 439/676
2003/0061322 A1 3/2003 Igarashi et al.
2003/0119370 A1 * 6/2003 Xu ..... H01R 12/585 439/676
2004/0107276 A1 6/2004 Mo
2005/0094661 A1 5/2005 Seligman et al.
2005/0164558 A1 7/2005 Ferentz
2005/0239339 A1 10/2005 Pepe
2005/0240666 A1 10/2005 Xu et al.
2005/0245127 A1 11/2005 Nordin et al.
2006/0047800 A1 3/2006 Caveney et al.
2006/0063406 A1 3/2006 Shifris et al.
2006/0154531 A1 * 7/2006 Kim ..... H01R 13/6658 439/676
2006/0223366 A1 10/2006 Murayama et al.
2006/0253557 A1 11/2006 Talayco et al.
2006/0282529 A1 12/2006 Nordin
2007/0022185 A1 1/2007 Hamilton et al.
2007/0237470 A1 10/2007 Aronson et al.
2008/0046553 A1 2/2008 Yamashita
2008/0049627 A1 2/2008 Nordin
2008/0113560 A1 5/2008 Caveney et al.
2009/0034226 A1 * 2/2009 Herndon ..... H01R 13/518 361/822
2009/0100174 A1 4/2009 Annareddy et al.
2009/0274422 A1 * 11/2009 Henry ..... H01R 13/7172 385/92
2010/0064502 A1 3/2010 Chen
2010/0255716 A1 * 10/2010 Frey ..... H04Q 1/13 439/540.1
2011/0115494 A1 * 5/2011 Taylor ..... H01R 13/436 324/537
2011/0189886 A1 8/2011 Chen
2011/0195598 A1 8/2011 Panella et al.
2011/0256738 A1 10/2011 Panella et al.
2012/0226807 A1 9/2012 Panella et al.
2014/0141643 A1 5/2014 Panella et al.
2014/0154895 A1 * 6/2014 Poulsen ..... H01R 13/6463 439/76.1
2017/0302040 A1 * 10/2017 Taylor ..... H01R 27/02

FOREIGN PATENT DOCUMENTS

| | | | |
|---|---|---|---|
| CN | 101771896 | A | 7/2010 |
| CN | 201663251 | U | 12/2010 |
| CN | 201985356 | U | 9/2011 |
| EP | 2355535 | A1 | 8/2011 |
| GB | 2 435 969 | A | 9/2007 |
| JP | 2008-035562 | A | 2/2008 |
| TW | 540877 | U | 7/2003 |
| TW | 200903223 | A | 1/2009 |
| WO | WO 02/39756 | A1 | 5/2002 |
| WO | WO 2009/074197 | A2 | 6/2009 |
| WO | WO 2012/129298 | A2 | 9/2012 |
| WO | 2016/022701 | A1 | 2/2016 |

OTHER PUBLICATIONS

International Preliminary Report on Patentability received for PCT Application No. PCT/US2015/043831, dated Feb. 16, 2017, 15 pages.

(56) References Cited

OTHER PUBLICATIONS

Partial Supplementary European Search Report received for European application No. 15829808.3, dated Feb. 8, 2018, 10 pages.
Extended European Search Report received for European application No. 15829808.3, dated Apr. 24, 2018, 12 pages.

* cited by examiner

PATCH PANEL FRAME FOR CIRCUIT BOARD MODULE

RELATED CASES

This application claims priority to U.S. Provisional Application No. 62/033,965, filed Aug. 6, 2014, which is incorporated herein by reference in its entirety.

BACKGROUND OF THE PRESENT DISCLOSURE

The Present Disclosure relates, generally, to structures utilized in data transmission networks, and, more particularly, to network panel assemblies, jacks for such assemblies, housings for holding such jacks in place within such assemblies, and light pipe arrangements for such assemblies all having improved structures that facilitate quick and reliable upgrading and assembly of data transmission networks.

Data transmission networks are widely used in business operations, including financial, retail, manufacturing, medical, education and engineering sectors. They typically are comprised of a central server or computer storage unit that is linked, or networked, to a plurality of end user devices. Such end user devices include any device that transmits or receives data, such as personal computers, docking stations, wireless transmitting facilities, while end user devices may include printers, scanners, facsimile machines and voice over internet phones and Internet Protocol- (IP-) enabled sensors, alarms, cameras and lighting systems. All of these devices are usually operatively linked, or connected together, by means of data transmission lines that utilize high speed data cables containing associated pairs of high speed data wires.

A company or enterprise may include numerous end-user devices, deployed throughout an office campus or building in individual offices and/or in common areas accessible to the network end-users, such as conference rooms, Wi-Fi areas and printer havens. The network devices in the form of switches and routers form the heart of an enterprise data communication network as they route data packets between end-user devices on local area networks or between the local area network and larger corporate wide area networks, as well as the Internet. Many of these routers and switch network devices are typically located in rooms known as wiring closets and in data centers. In order to provide connections between the various end-user devices, the network devices are interconnected by cables in a one to one relationship. Cables may be used to connect data transmission lines to routers and switches which direct the data signals to end-user devices.

A network often utilizes network panels as one means of interconnection and the network panels, typically called "patch panels," are interposed between the end user devices and switches or routers and may be used to connect the end user computers to internal networks or the Internet. Patch cords, or patch cables, are utilized to interconnect the various data transmission lines to the network devices. Space is at a premium in wiring closets and therefore it is advantageous to find ways to reduce the size of patch panel assemblies, or increase their capacities. Such patch panel assemblies may include a circuit board that is fixed in place within the panel assembly, a housing that is mounted to the circuit board and attached to a panel face and/or frame, and one or more data jacks that are held in the housing to define a plurality of panel ports, each of which accommodates a multi-wire jack. The wires of the data transmission cables running from the end user stations or devices are terminated to the back faces of the jacks of the panels, typically using a wire punch, onto insulation-displacement terminals. Patch cords are used to then connect the data transmission lines associated with one patch panel to ports (jack openings) of another network panel. Patch cords may be used in this manner to connect the data transmission lines to specific end user stations or devices.

Patch panels may be considered as the nerve center of an enterprise's information technology or data transmission system as they are the main links to connect data and route it to where it needs to go. Patch panels serve a central role in the administration of the telecommunications network in that they enable the process of moves, adds and changes of end user stations and devices. In today's complex office architecture, patch panels represent the only useful way to transfer lines from one office to another. For example, if two workers must transfer desk locations, a simple switch of patch cords into various ports on a patch panel can ease the move. Without this capability, much time and energy would be spent terminating cable that would have to be hard-wired. Patch panels are typically manufactured in standard widths and heights and a typical standard size patch panel includes 24 ports. These ports accommodate up to four wire pairs each for a total of 96 wire pairs. Those wire pairs are terminated to the termination face of the jacks by way of respective associated termination blocks, each of which supports a plurality of insulation displacement terminals. The data cables and their associated wires are supported on a frame at the rear of the panel and these cables tend to reduce the space available for manipulation of the cables. It is very time-consuming to change out patch panel components and the tight clearances associated with them make the changing, or upgrading, process difficult.

Changing or upgrading conventional patch panel assemblies is troublesome as the jacks may be mounted all together, as shown and described in U.S. Pat. No. 8,251,707, issued 28 Aug. 2012 to the assignee of the Present Disclosure, the content of which is hereby incorporated herein in its entirety, in an arrangement upon one side of a first circuit board and termination blocks for the jacks are mounted on the opposite side of the first circuit board. In this design a second circuit board is connected to the first circuit board and spaced apart therefrom in order to support electronic components that affect the data transmission to and from the ports. These first and second circuit boards are supported as an interconnected pair, along with operational indicators on the second circuit board that typically take the form of light-emitting diodes ("LEDs"). These two circuit boards, their jacks and termination blocks form an integrated assembly that supports the electronics required for all 24 ports of the patch panel. All of the relevant electronics are supported on these two circuit boards. If a user needs to repair an electronic component or replace either of the panels, requires that all 24 ports of the patch panel are taken out of operation.

Furthermore, replacement of one of the data jacks, or even an indicator LED, due to failure or upgrading requires that all the supporting circuit boards be disassembled so that the jack or LED in question may be accessed. This takes a longer time than desirable and the negative effect of structures such as these are that it becomes close to impossible to do panel upgrades efficiently as all the panel components must be removed to access a single jack or other components. The jacks are further supported by the first circuit board in a manner such that termination of the cable wires must be performed carefully so as not to apply any excessive punch down forces to the first circuit board. Additionally, with such a structure, a user must purchase all the components necessary for all 24 ports of the patch panel and cannot simply start with a few ports and subsequently increase the capability of the patch panel. This can weaken already thin budgets for an enterprise that seeks to increase its IT capability as it grows. The structures shown in the '707 patent are not modular and cannot be replaced in smaller, discrete groups. That is one disadvantage to a conventional patch panel assembly.

Another disadvantage to such conventional patch panel structures is, as noted above, where the data jacks and termination blocks are mounted directly to a first circuit board or a monolithic circuit board assembly, care must be taken and specialized tools may need to be used to properly effect the termination of the wires of the data cables in a manner not to unduly transfer termination forces to the first circuit board. Similarly, because the jacks are affixed to the first circuit board, these conventional patch panel systems do not have any "pluggable" aspect to their jacks, where an installer can merely insert each jack individually into a housing, after terminating the cable wires to it, in order to repair, replace or upgrade the jack.

The circuit boards utilized on the aforementioned patch panels not only extend the entire width of the patch panel but they support components used for all of the ports of the panel. Failure of the components associated with one or more panel ports requires removal of the entire circuit board and usually replacement of it, as well. This is expensive when not all of the ports in the panel have failed or need attention. The known patch panel assemblies described above do not permit individual port repair or replacement insofar as the circuit boards and the electronic components mounted thereon are concerned. Consequentially, certain individuals would appreciate improvements to a patch panel assembly.

SUMMARY OF THE PRESENT DISCLOSURE

Accordingly, there is provided a patch panel assembly with an improved, modular structure and a replaceable circuit board and port jacks associated with each such group of ports which facilitates upgrading and repair of the patch panel.

Accordingly, there is provided a novel housing-style connector, or bezel for use with an associated patch panel, wherein the housing receives a plurality of data jacks in a pluggable fashion in one set of openings and receives circuit boards in another set of openings, in a manner so as to advantageously reduce the time required for upgrading or replacing portions of a patch panel. Further, there is provided a patch panel with an associated light pipe assembly that includes a housing supporting light pipes such that receiving ends thereof are aligned with LEDs supported on circuit board(s) which are insertable into openings of the circuit board.

Further, there is provided an improved data jack for use with patch panels having a structure that permits the jacks to be releasably mounted in a housing within the patch panel wherein the jacks have exterior terminals for connecting to circuits on an associated circuit board by way of interconnecting terminals supported on the housing. There is further provided an electronic module which may be easily inserted and removed from engagement with the patch panel assemblies of the Present Disclosure, wherein the module includes a circuit board supporting various electronic components which are required for monitoring patch cord placement and the connectivity of the network, the module further including a cover plate and a base plate assembled together in a spaced apart fashion with a locking mechanism to hold the circuit board in place in engagement with the frame of the patch panel housing.

Accordingly, there is also provided a patch panel assembly that supports a face plate, one or more housings that engage the face plate with the housings including a plurality of data jack openings and a plurality of circuit board openings wherein the circuit board openings are disposed in the patch panel assembly beneath the jack openings, and the assembly having a cable manager that is maintained in a spacing from the rear of the face plate, wherein the cable manager and the jacks are maintained at a preselected level defining a nest underneath them so that modules containing circuit boards may be inserted and removed from the panel assembly as necessary without interferingly contacting jacks in the jack openings or cables terminated to the jacks.

In accordance with an embodiment as described in the following Present Disclosure, an improved patch panel assembly is provided that facilitates the upgrading, replacing and repair of the panel. The patch panel has a frame that supports a panel face plate that accommodates a plurality of ports. A plurality of housings, each housing configured to support a specific number of ports, is provided to fit into the patch panel frame. The housings include means for engaging the frame so as to fix the housings in alignment with the patch panel face plate. The housings preferably include a plurality of first and second openings. The first openings are aligned together along a first axis and the second openings are aligned together along a second axis. The first and second openings are spaced apart from each other and the first and second axes are preferably generally parallel to each other. The first openings of the housings accommodate individual jacks, while the second openings are dimensioned to accommodate mating ends of circuit boards. The first openings have vertical axes, while the second openings have horizontal axes.

The housings are preferably configured to accommodate a certain number of data jacks, such as 1, 2, 3, 4, 6, 8, 12 or 24 data jacks in their first openings. They include clips or tabs formed proximate to their first openings which extend into the openings in a manner to engage an opposing portion of the data jacks. The second openings preferably take the form of slots that are configured to receive mating blades of one or more printed circuit boards. In order to connect circuits of the circuit boards to the wires terminated to the jacks, the housing includes sets of terminals supported in an interposing fashion, so that the terminals have one set of free ends that are aligned with contact pads on the circuit boards, the terminals further includes a second set of free ends which are aligned with terminals tail portions of the data jacks. The housing terminals are supported on the housing so that they are interposed between the data jacks and the circuit boards and the terminal tails have a preloaded spring structure that permits them to accommodate dimensional variations in the jacks and circuit boards. The housing first openings serve to align the jacks to the circuit boards in order to ensure reliable connections there between.

One or more circuit boards are also provided with electronic components utilized for data transmission and the circuit boards may be made in widths so that they match, in number, the number of associated second openings of the housings. In this regard, the patch panels of the Present Disclosure have a modular nature in that the housings and the circuit boards may be matched together by the number of jacks they accommodate. For example, a 24 port patch panel may include six housings that accommodate 4 jacks each and six circuit boards that engage respective single housings. Such a patch panel would be considered as having six individual modules. Likewise, if only three housings were provided accommodating 8 jacks each, then only 3 circuit boards would be required for that patch panel. The circuit boards contain mating blades at their ends which are inserted into the second openings of the housings. The other ends of the housing terminals ride along the surfaces of the circuit boards and make contact with circuits thereon by way on an array of contact pads.

The circuit boards used in the patch panel assemblies of the Present Disclosure are preferably held together in a module style format. That is, the circuit boards are held in enclosures between top and bottom cover members and spaced apart therefrom by way of standoffs or the like. The top and bottom cover member may be supported by a backing bar that extends for the width of the circuit board. The backing bar preferably has one or more engagement hooks associated with it that will engage opposing slots in the patch panel frame so that the circuit board modules may be effectively locked in place in their engagement with the patch panel frame and in their mating engagement with the patch panel housings. The backing bar serves as a handle for a user to insert and removes selected individual circuit boards from the patch panel assembly without the need for removing either other circuit boards or any of the jacks.

Alternatively and preferably, a single circuit board could be used in place of multiple circuit boards, spanning across multiple housings. Thus, if a user wishes to slowly build his patch panel up to a full 24 port complement, he can begin by purchasing and installing one module comprising one housing, one circuit board and whatever number of jacks the housing may accommodate. When the user wishes to expand his patch panel, he can purchase one or more additional modules and, in effect, "plug" them into place without disconnecting the jacks which are already in place in the patch panel with previously installed modules. This structure permits quick upgrades insofar as adding additional jacks is concerned. If a user wants to upgrade his entire panel or one or more modules thereof, he can easily remove the existing jacks and circuit boards and replace them with upgraded jacks and circuit boards, without disassembling any significant portion of the patch panel assembly. Hence, the patch panel assemblies of the Present Disclosure provide for "smart" panels that are more efficient and less expensive to maintain and install.

In another embodiment of the Present Disclosure, an improved data jack is provided. The jack includes an exterior metal or plastic housing that defines a hollow interior in which a plurality of terminals and an insulative body portions are housed. The terminals engage an internal circuit board and circuits thereon that lead to insulation displacement terminals ("IDTs"), and these two sets of terminals preferably extend in opposite directions. The internal circuit board is preferably vertically oriented within the housing and provides an interconnection between the jack contact terminals and its IDT tail terminals. Advantageously, the internal circuit board also has a series of third, or exterior, terminals connected to it and these exterior terminals include tail portions that extend out from the jack body and outside the jack housing. The jacks have an integrated structure that permits cable wires to be terminated to them in an easy manner, using standard punch down tools.

The data jack housings are configured to be accommodated with the first openings of the housings, and the tail portions of the exterior terminals have free spring ends and are aligned with the housing interposer terminal one ends. In this manner, when the jacks are inserted into their assigned first openings, their exterior terminal tail portions will make contact with the interposer terminals of the housings and thereby connect to selected circuits on the circuit boards. The jacks further include one or more tabs or stops that define reaction surfaces of the jack which may be engaged by latch members which are formed in the housing first openings. The latch members are configured so they have contact surfaces on opposite sides so that a tool may be used from either the front or rear of the patch panel to release the latch from engagement with the jack and free the jacks from the housing first openings. In this manner, the jacks are releaseably held in place in the housing first openings in a secure manner so that releasing the engagement between the jacks and the housing is easily effected by use of a screwdriver or other bladed tool. The jacks may also be upgraded, replaced or repaired in the field without having to re-cable the patch panel assembly.

The patch panel is provided with grounding clips to ensure a reliable grounding contact among the jacks and the patch panel faceplate. The sidewalls of the housing first openings prevent substantial sideways movement of the jacks and the top and bottom walls of the openings prevent the jacks from working free in vertical directions. The jack housings may include one or more shoulder portions that confront and contact opposing surfaces on the housing to limit the extent to which the jacks may be inserted into the housing first openings. Internally, the jack may be provided as in another embodiment, with an insertion-activated switch that includes a terminal contact that extend upwardly at an angle within the opening of the jack and is pressed down into contact with another terminal contact when a plug is inserted into the jack opening. This provides a means of testing the connectivity and continuity of the particular port with which the jack is associated.

In still another embodiment of the Present Disclosure, the panel frame is constructed such that the housing maintains the jacks held in the housing jack opening at a distance above the circuit board openings. A cable manager which will support a series of network cables is provided that extends laterally with respect to the patch panel assembly and is maintained at an elevation equal to that of the jacks. The cable manager supports the jack cables, also at an elevation that it equal to that of the jacks. In this manner, a clearance is defined beneath the jacks, which defines a nest into which the circuit board module may be inserted or removed as desired. The nest accommodates the module in a manner such that replacement of modules can be effected without disturbing the jacks associated with the module.

In yet another embodiment of the Present Disclosure, a plurality of light pipes is provided extending between the circuit board and the front face plate of the patch panel. These light pipes are part of an overall status indicating system of the patch panel and are illuminated by way of LEDs disposed on the patch panel circuit boards. In order to conserve valuable space, the housings are provided with channels which are associated with each of the first openings. The channels extend lengthwise through a base of the housing and underneath both the first and second openings thereof. The light pipes have opposing receiving and transmitting ends. The receiving ends of the light pipes are aligned with LEDs positioned on the circuit boards, and preferably the bottom surface thereof. The transmitting ends are aligned with and may extend through openings in the patch panel face plate and associated with particular ports thereof. The housing channels which accommodate the light pipes may communicate with the second openings so that the receiving ends of the light pipes may lie as flush against the LEDs as possible.

The transmitting ends of the light pipes extend underneath the housing in respective cavities aligned with the first openings. The light pipes may have offset configurations so that the transmitting ends thereof abut the bottom surfaces of the housing front cavities. In addition to the height of the housing second openings, the housing interposer terminal other ends preferably take the form of cantilevered spring arms that cooperatively exert and downward pressure on any circuit board inserted therein and this pressure assists in ensuring the light pipe receiving ends contact the circuit board LEDs. The LEDs and the light pipe input ends are arranged within the panel frame so that simple insertion of the circuit board modules into engagement with the patch panel frames will align them for abutting engagement.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
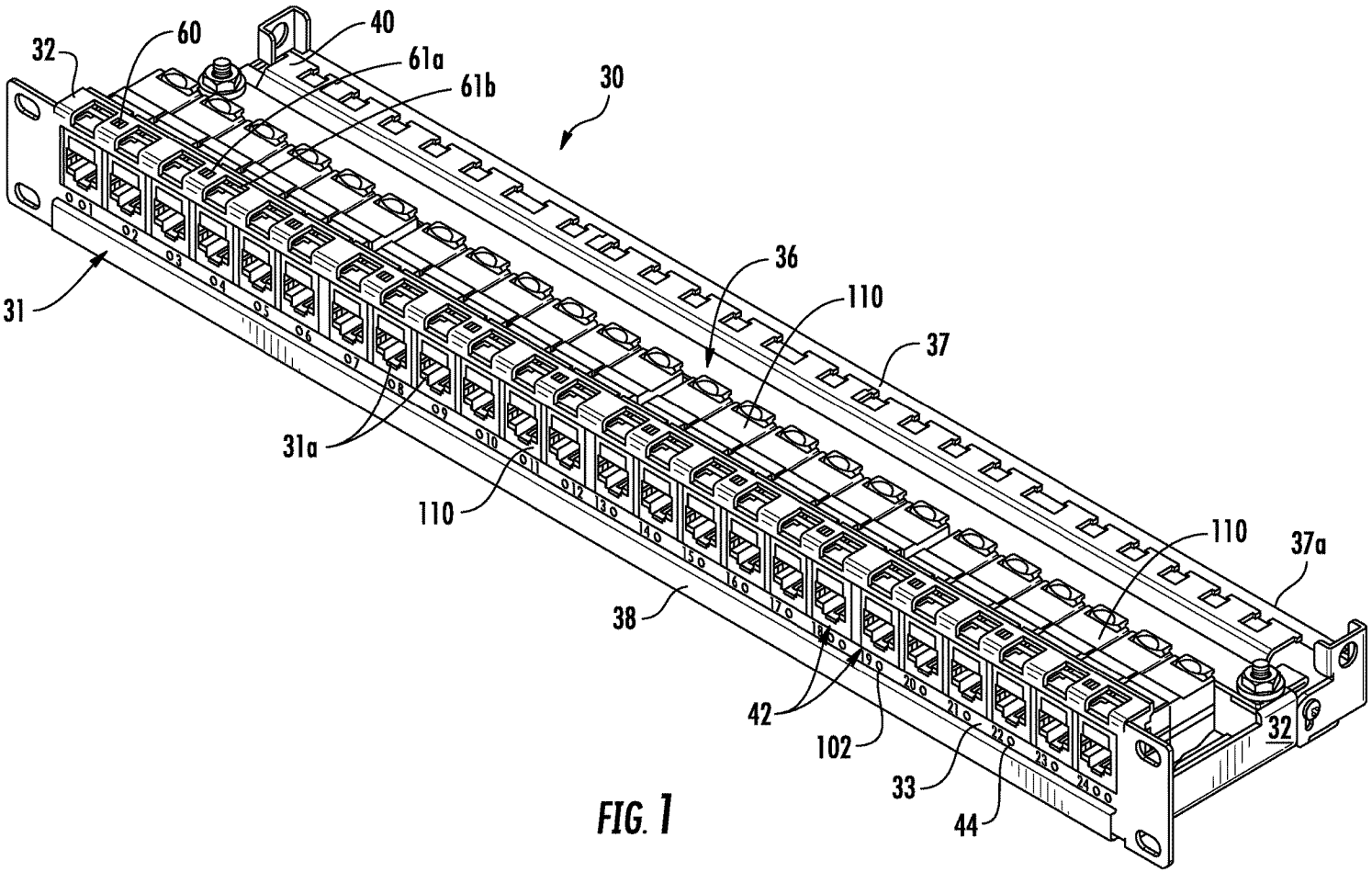
FIG. 1 is a perspective view of a network panel incorporating improvements in accordance with the Present Disclosure.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Many embodiments are described herein. For example, such embodiments include but certainly are not limited to: Patch Panel Assemblies with Modular Aspects, an Interconnecting Housing For Network Patch Panel, a Data Jack With Exterior Terminals, a Light Pipe Assembly For Network Patch Panels, a Patch Panel Frame With Module-Receiving Nest, and Circuit Board Modules For Use With Patch Panel Assemblies. General descriptions of these example embodiments follow as an introduction to their more detailed descriptions with reference to the Figures.

Patch Panel Assemblies with Modular Aspects: An improved patch panel assembly includes a frame and faceplate that mate with a housing, and the housing defines a plurality of individual communication ports. The housing is mounted to the patch panel frame and includes jack openings that accommodate data jacks and circuit board openings that accommodate mating blades of circuit boards. The two sets of openings are separated on the housing by an intervening spacing and interposer terminal sets are provided to electrically interconnect the jacks with circuits on the circuit boards. The patch panel housings may be formed in discrete groupings so that, if desired, the patch panels may have ports that are grouped together by bandwidth, storage capability and the like. Inasmuch as the housings are mounted to the patch panel frames, the jacks and the circuit boards can be easily and individually replaced, repaired or upgraded with similar components without requiring disassembly of the patch panel.

Interconnecting Housing For Network Patch Panel: A housing for housing and interconnecting components of a patch panel assembly includes a body portion with first openings that are configured to releasably receive data jacks therein, and second opening that are configured to receive mating blades of printed circuit boards. The first and second openings are aligned together in distinct rows so that the first and second openings are spaced apart from each other. In order to interconnect terminals of the data jacks with circuit on the circuit boards, a plurality of conductive terminals are provided and are supported by the housing body portion. The terminals are located between the first and second openings and the terminals include free ends that extend toward the openings so that insertion of the jacks and circuit boards causes the terminal free ends to contact same and electrically interconnect them together.

Data Jack With Exterior Terminals: An improved telecommunications jack is provided that reduces the time for repair, replacement and upgrading of network patch panel components. The jack includes an exterior metal housing in a configuration dimensioned to fit into a first opening of a housing of the patch panel. The jack housing includes one or more stop surfaces that are engaged by a latch member on the housing which extends into the first opening. The jack has an interior hollow cavity that accommodates a plurality of conductive terminals that mate with a data plug inserted into the jack. A flexible terminal is disposed in the jack cavity and flexes under pressure of an inserted plug to contact another terminal and signal that the plug is inserted. The jack further includes a plurality of terminals that extend outside of the housing and into contact with terminals supported by the patch panel housing.

Light Pipe Assembly For Network Patch Panels: A light pipe structure particularly useful with network patch panels includes at least one housing that defines a preselected number of communication ports of the panel. The housing has individual openings that receive individual data jacks and a common opening that receives one or more mating blades of a circuit board. Each housing has its board-receiving opening disposed beneath its set of jack openings and channels are provided in the housing that receive and support light pipes. The channels communicate with the broad-receiving openings so that the transmitting ends of the light pipes may confront light-emitting diodes mounted on the circuit boards, when the circuit boards are inserted into the board-receiving openings of the housing. The display ends of the light pipes may be arranged beneath individual panel ports.

Patch Panel Frame With Module-Receiving Nest: A patch panel assembly has a frame structure that includes a face plate, a base plate, a jack housing and a cable manager. The housing has first openings for jacks and second openings for circuit boards. The second opening are located beneath the first openings so that any one circuit board may be inserted or removed without necessitating removal of the remaining circuit boards. Additionally, the jacks are maintained at a certain level within the patch panel frame as are their associated cables, managed by a cable manager at a similar level above the base plate of the patch panel frame. This difference in elevation defines a nest that accommodates circuit board modules that may be inserted and removed in a pluggable fashion.

Circuit Board Modules For Use With Patch Panel Assemblies: A patch panel assembly has a frame structure that includes a face plate, a base plate, a jack housing and a cable manager. The housing has first openings for jacks and second openings for circuit boards. The circuit boards are supported within modules that include corresponding engaging cover and base plates that define a modular enclosure. Standoffs support the circuit boards within the modules in an orientation such that they can easily be inserted and/or removed from the patch panel housing second openings.

Figure 2:
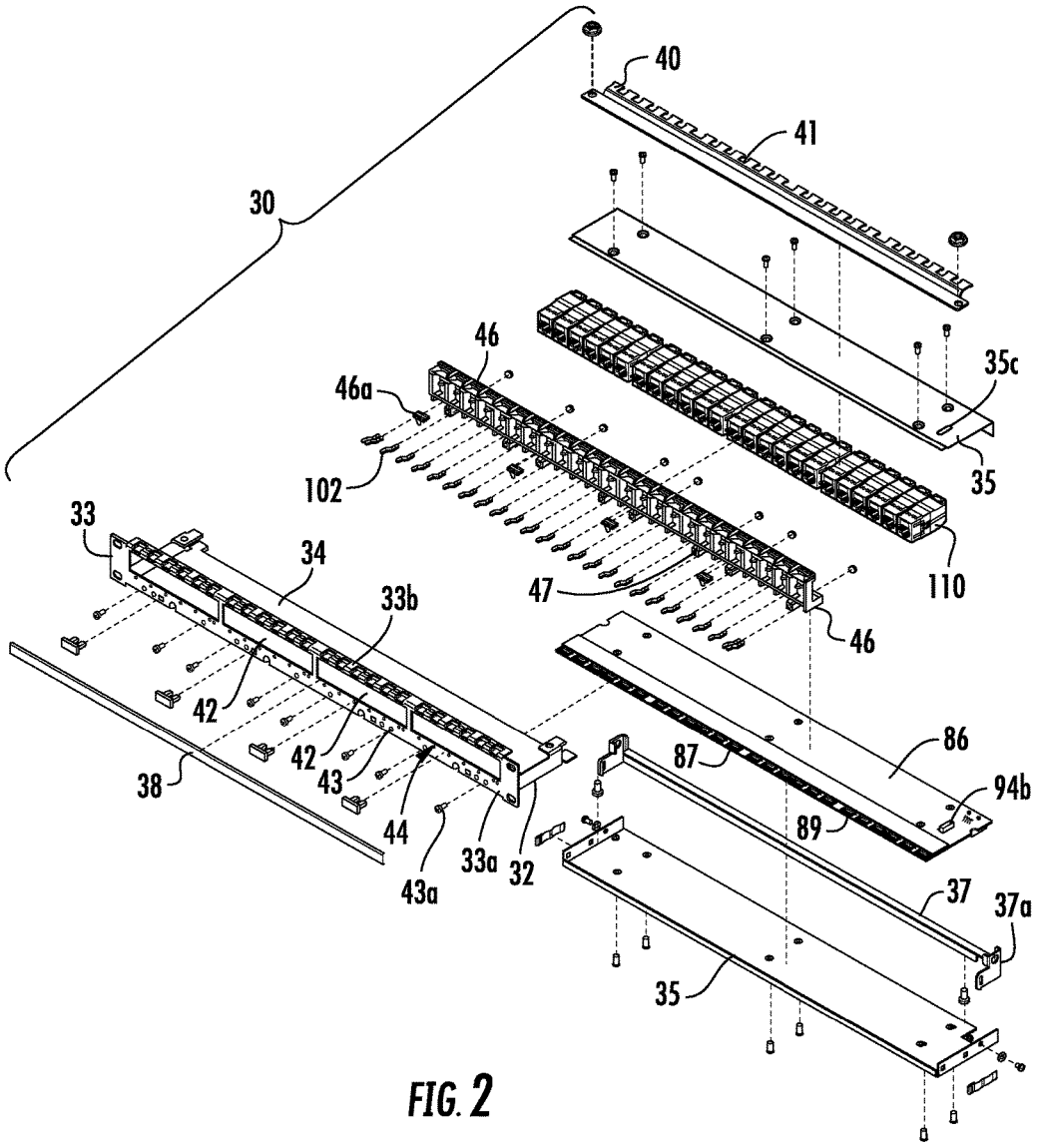
FIG. 2 is an exploded view of the network panel of FIG. 1.
Figure 3:
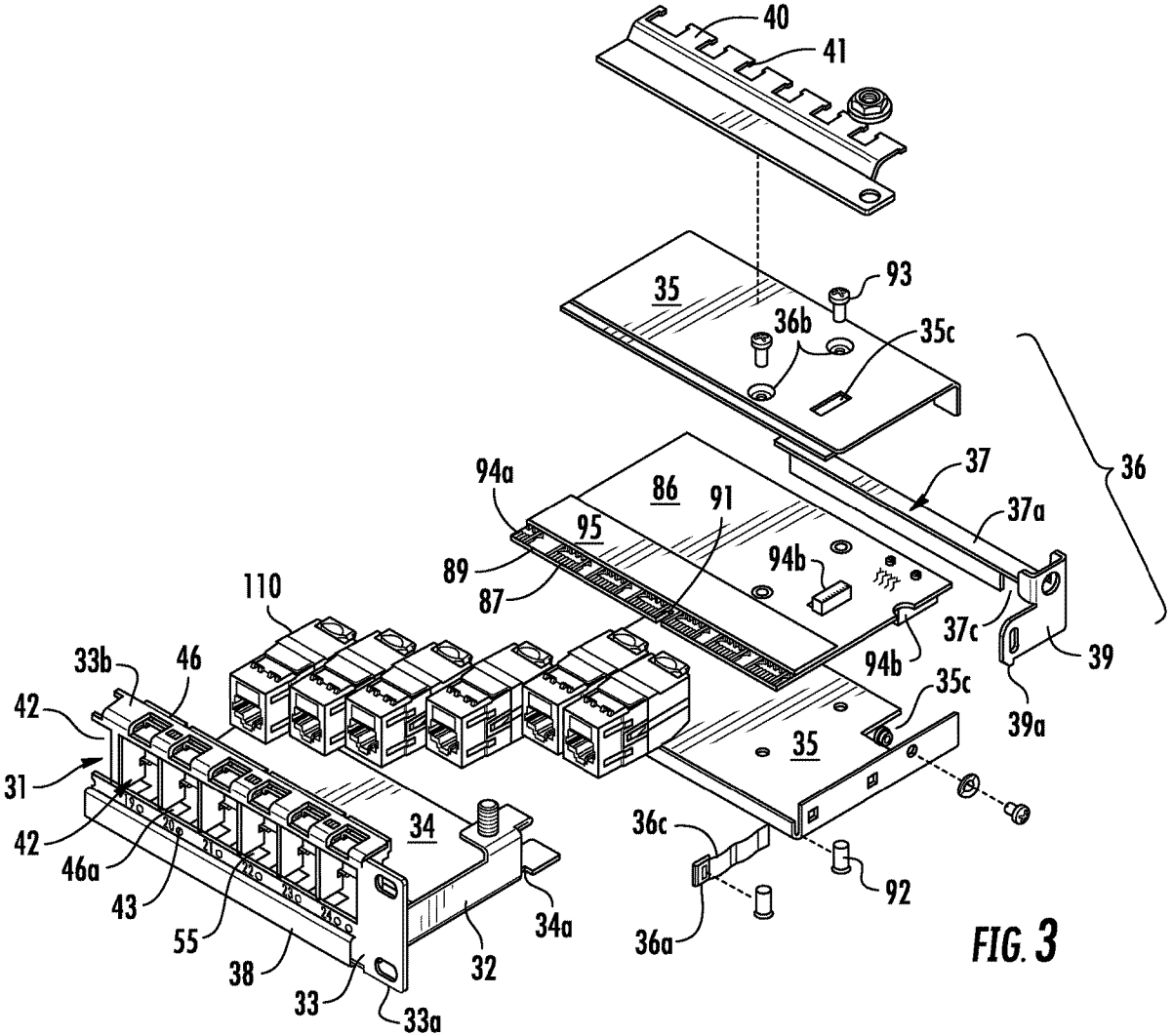
FIG. 3 is an exploded view of one bay of the network panel of FIG. 1.

FIGS. 1-2 illustrate a patch panel assembly 30 constructed in accordance with the principles of the Present Disclosure having an improved structure which provides beneficial results when used in association with a data communication network. The patch panel assembly 30 includes a patch panel 31 comprising an elongated frame 32 having an associated elongated face plate 33 that extends widthwise along the frame. The panel frame 32 may include, as shown, a rearward extending base plate or portion 34 that defines a floor, or receptacle, which may receive a module assembly 36 therein. The face plate 33 and base plate 34 may be integrally formed together as illustrated, or may be separately formed and joined together in a conventional manner such as by screws, nuts, clips and the like.

The panel face plate 33 extends in two directions. The face plate 33 includes a front portion 33*a* that faces outwardly and which has port identifying characteristics such as numbers, symbols and the like, and a top portion 33*b* bent from the front portion 33*a* to extend rearwardly therefrom. The top portion 33*b* may also be considered as a retainer bar, or member, because it includes a plurality of stop surfaces and openings that are configured to engage complimentary shaped engagement members or panel housings 46, noted in more detail to follow.

A cable manager 40 is provided and it extends widthwise between mounting ends 32*a* of the patch panel frame 32, which may be bent inwardly, as illustrated, and may be secured thereto by nuts 32*b* on a mounting bolt 32*c*, as illustrated. The cable manager 40 is offset toward the rear of the patch panel assembly 30, as shown, and is preferably raised with respect to the panel 32 in order to define a widthwise space through which cables (not shown) connected to the jacks 110 may be run. The cable manager 40 has a serrated end configuration with a plurality of slots 41 formed therein for supporting cables which are terminated to the panel jacks 110. A circuit board module 36 is shown as rectangular in configuration and is provided that at least partially encloses a circuit board 86 associated with a particular section of the patch panel assembly 30. The circuit board module 36 includes a base plate or bottom cover 35, a top plate or cover member 35*a* and an end plate 37, which cooperatively define a hollow enclosure for the circuit board 86 utilized in assemblies of the Present Disclosure.

The end plate 37 closes the rear end of the module 36 and further can be configured to define a handle 37*a* by which a user can easily insert and remove the modules 36 from their position in the panel frame and engagement with the housing circuit board openings 56. The cover plate 35*a* extends over a portion of the circuit boards 86 utilized in the patch panel assemblies 30 and provides a means to protect the electronic components supported on and connected to the circuit board 86.

Standoffs 92 in the form of threaded tubes 92*a* (FIG. 22A) are provided to support the circuit board 86 above the base plate 35 and away from the cover plate 35*a* and may be used in conjunction with recesses 36*b* formed therein. Corresponding screws 93 engage the tubes 92*a* to orient the circuit board 86 properly within the module 36 at a height suitable for reliable engagement with the housings 46. The circuit board leading edge projects outwardly from the interior of the module 36 and it extends between and past the respective leading edges of the base and cover plates, 35, 35*a* and into alignment and engagement with the circuit board openings 56 of the panel housing 46.

Figure 11:
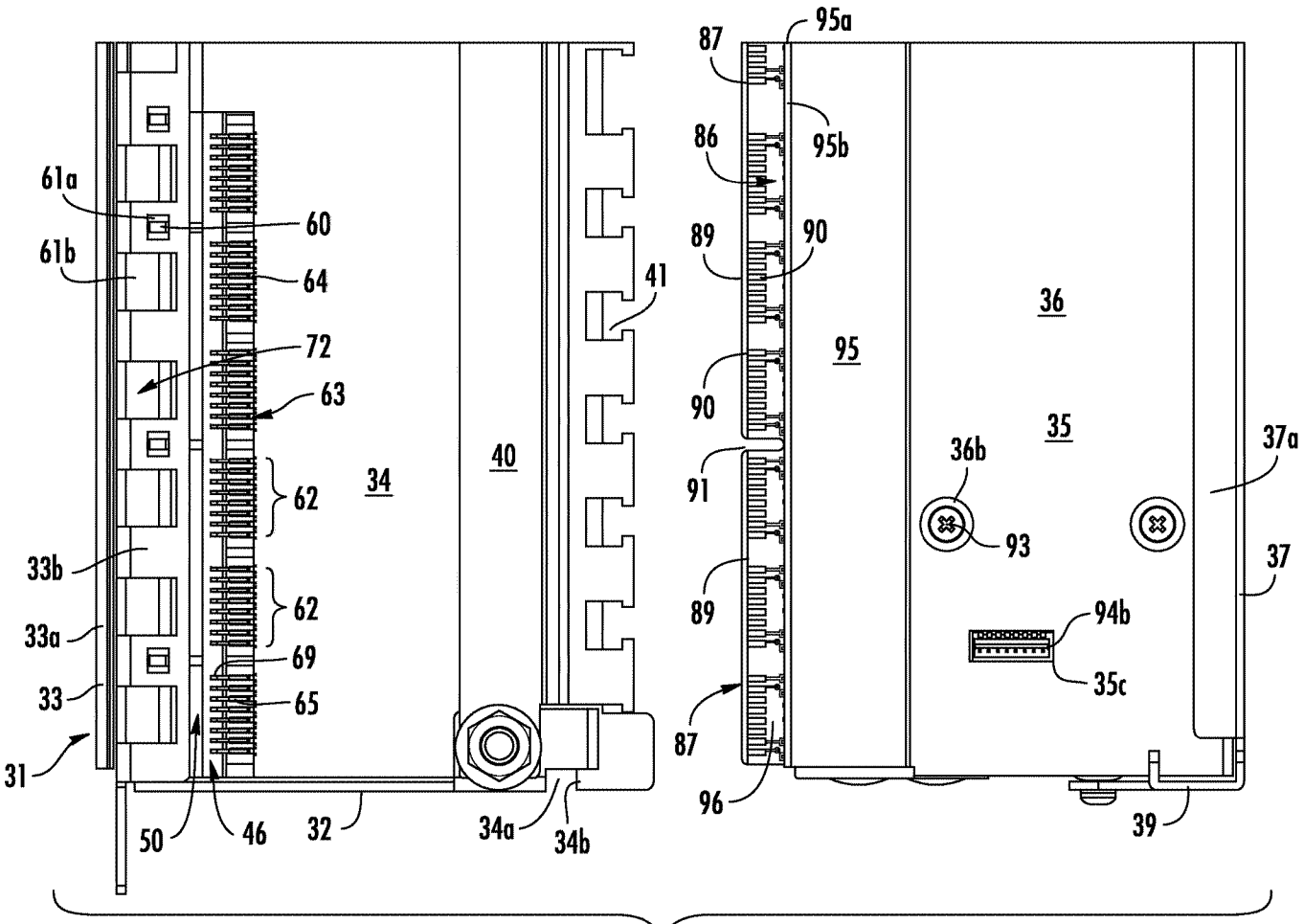
FIG. 11 is a top plan view of a network panel bay without any jacks in place, and illustrating the network panel circuit board spaced apart from and in alignment with the bezel member.
Figure 12:
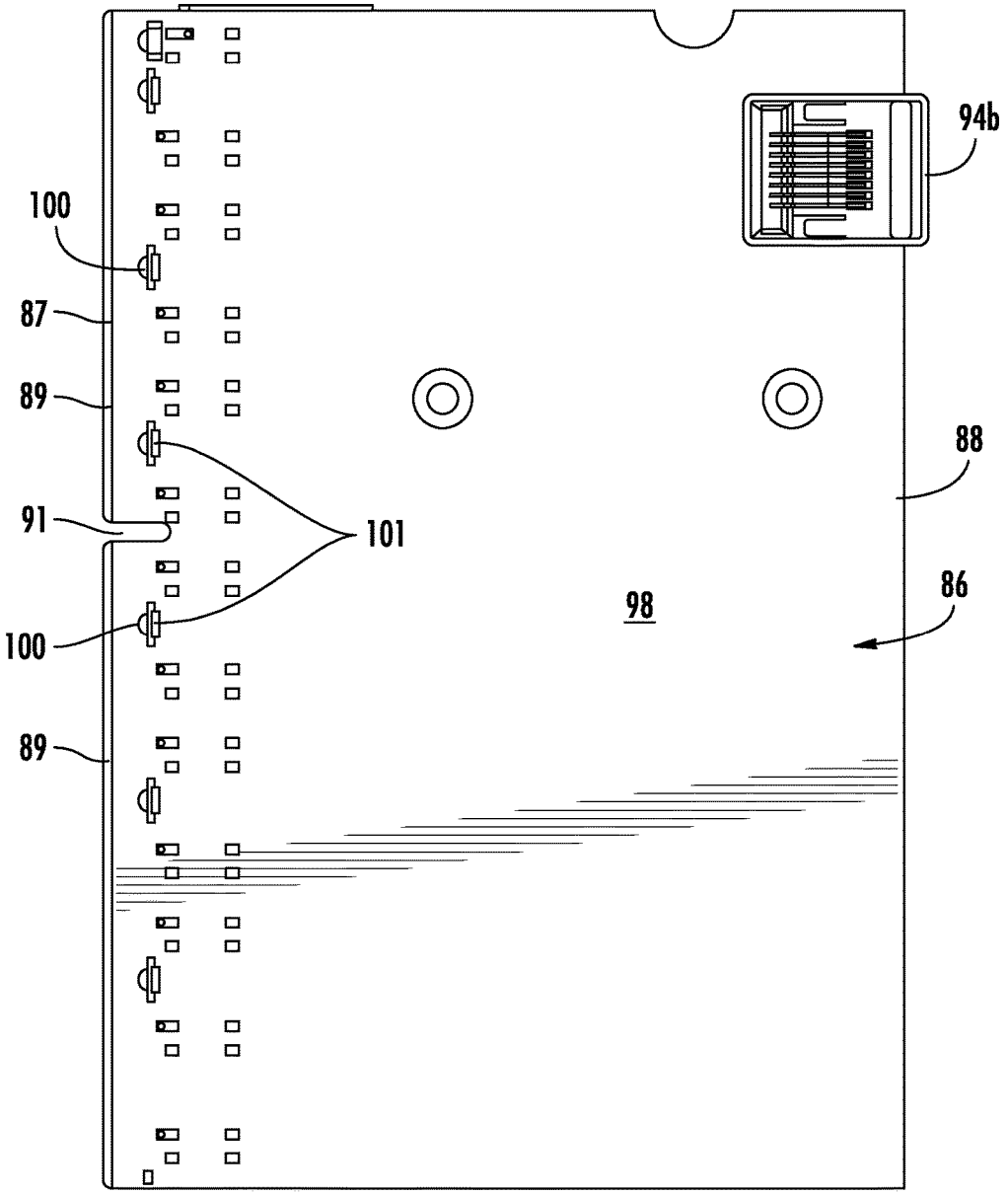
FIG. 12 is a bottom plan view of a portion of a circuit board used in the network panels assemblies of the Present Disclosure.
Figure 16:
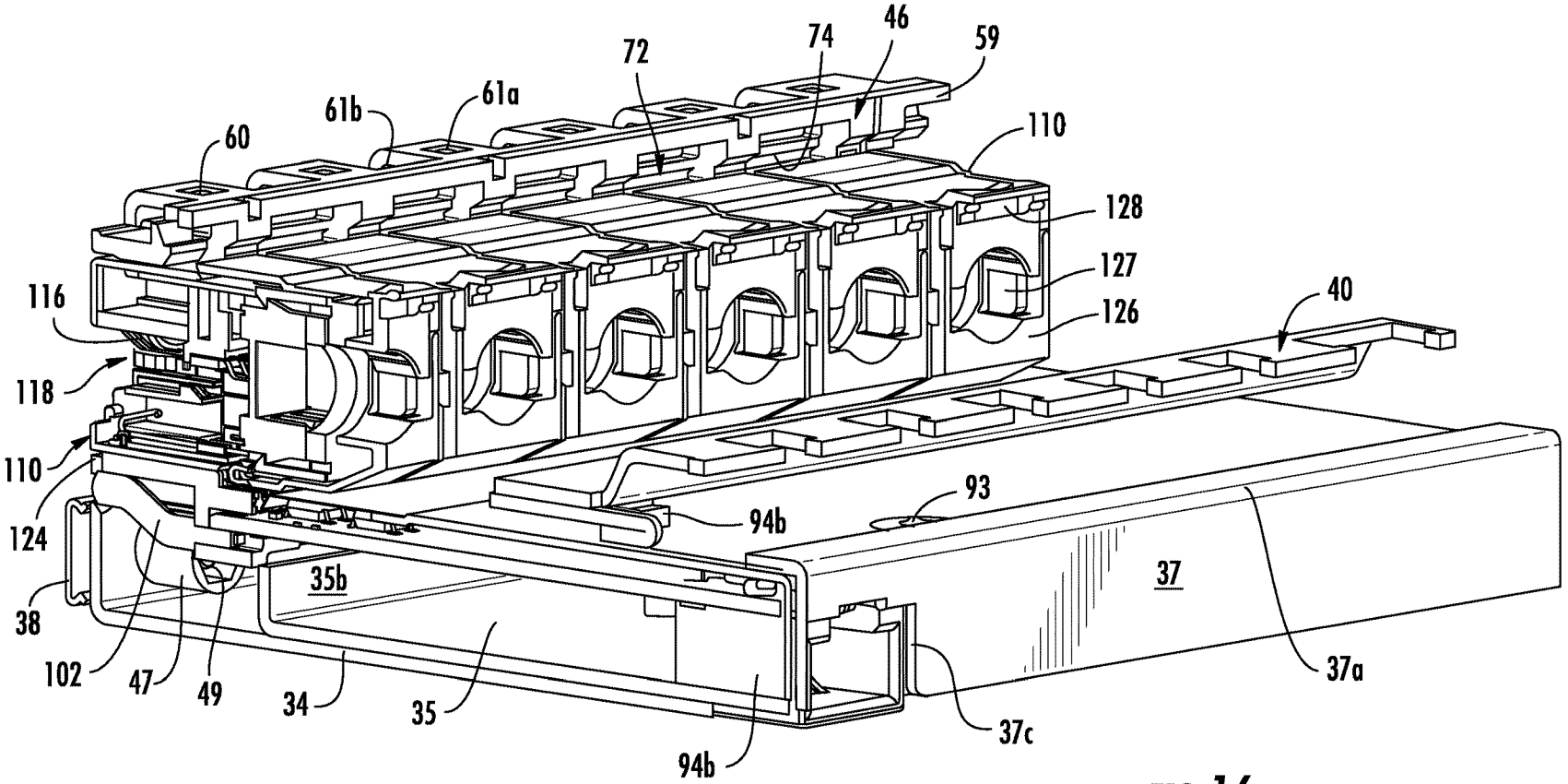
FIG. 16 is a perspective view, taken from a different angle of the network panel bay of FIG. 14.
Figure 17:
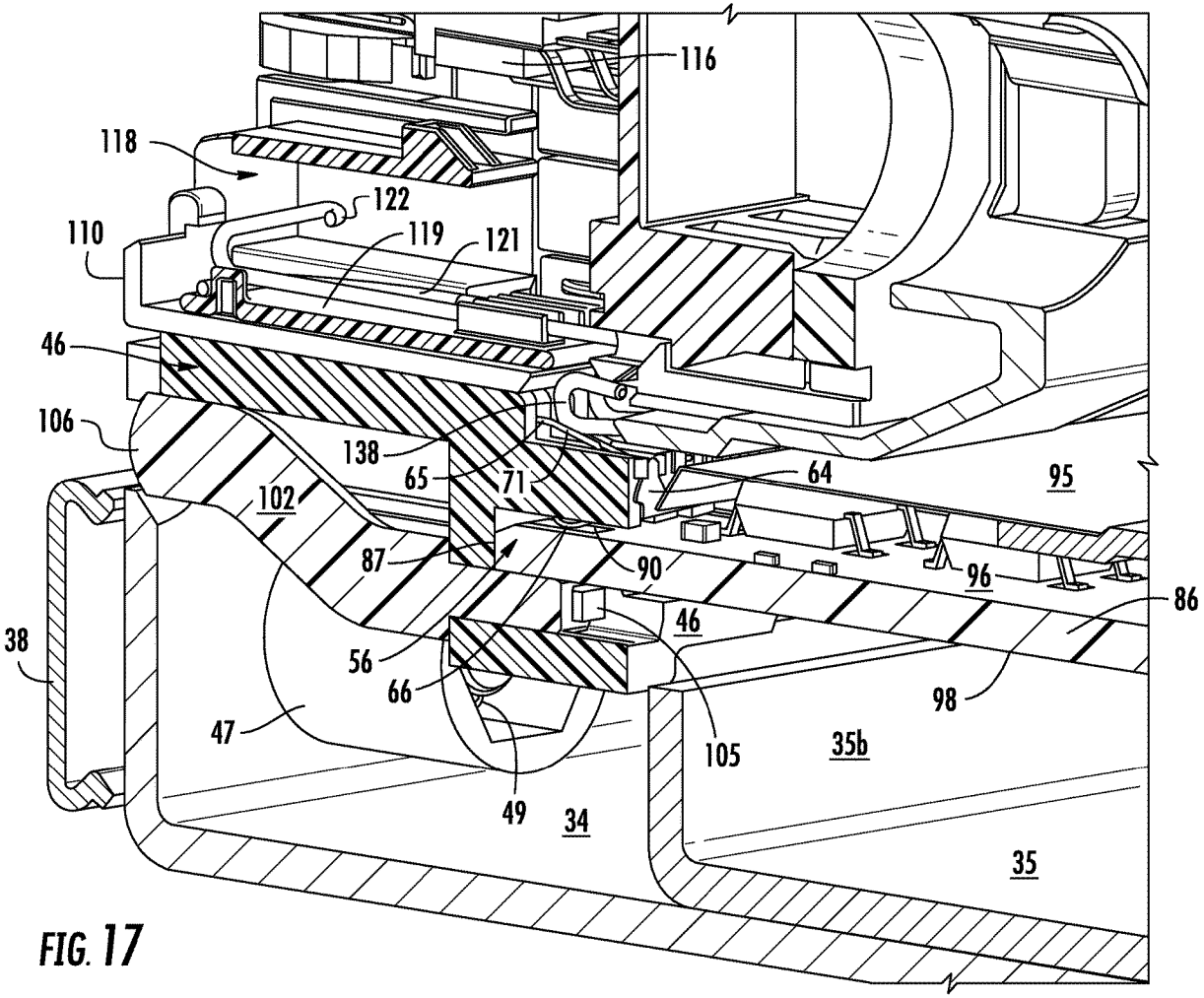
FIG. 17 is an enlarged detail, sectional view of the interconnection between a bezel member, jack and circuit board utilized in a network panel assembly of the Present Disclosure.
Figure 18:
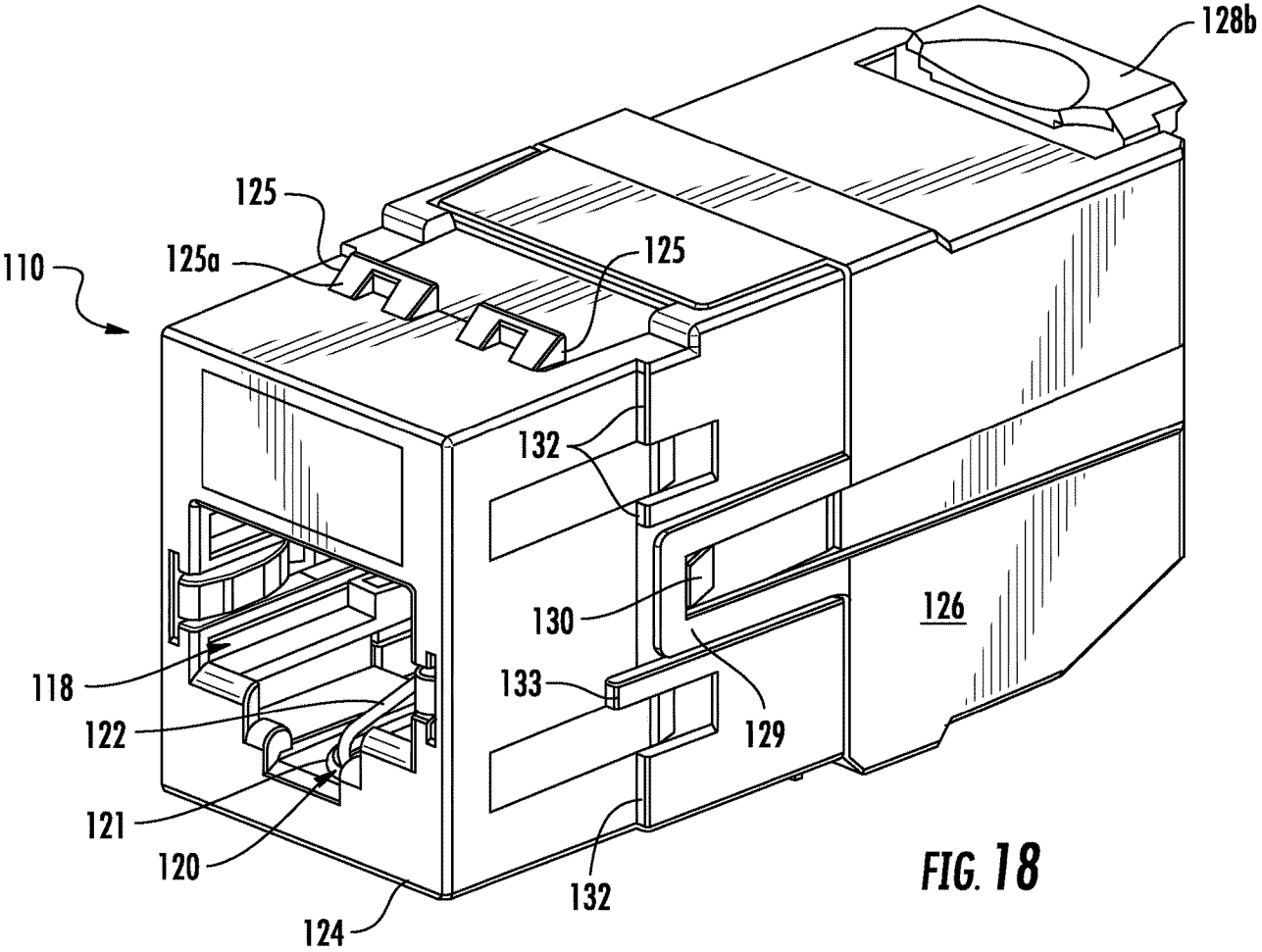
FIG. 18 is a perspective view of a data jack utilized in network panel assemblies of the Present Disclosure.

The circuit board 86 of the patch panel assembly 30 is spaced apart from and above the base plate 34 of the 30, and may include not only electronic components 94*a*, such as amplifiers, logic gates, controllers and the like, but also one or more connectors 94*b* supported on the top and/or bottom surface 98 of the circuit board 86. The connectors 94*b* may extend as shown either vertically or horizontally, and accordingly, the cover plate 35*a* and end cap 37 are provided with openings or penetrations 35*c*, 37*c* that permit the receptacle portions of the connectors 94*b* to be accessed. As illustrated best in FIGS. 11 and 16, these connectors 94*b* provide a means to connect to the circuitry of the circuit board 86.

Although illustrated in the Figures as a single circuit board 86, it will be understood that the structure for the patch panel assemblies of the Present Disclosure will permit the use of multiple circuit boards, depending on the system designer's needs. In such instances, multiple circuit boards may be associated with single or multiple panel housings 46. Such a structure will permit an incremental, "drop-in" expansion with the system operator being able to insert additional circuit boards 86 to increase system capacity or the like, rather than remove and replace a single circuit board. Such multiple circuit boards may be associated with respective single panel housings 46, or they may be associated with a plurality of them such as two, or three, panel housings 46.

Figure 6:
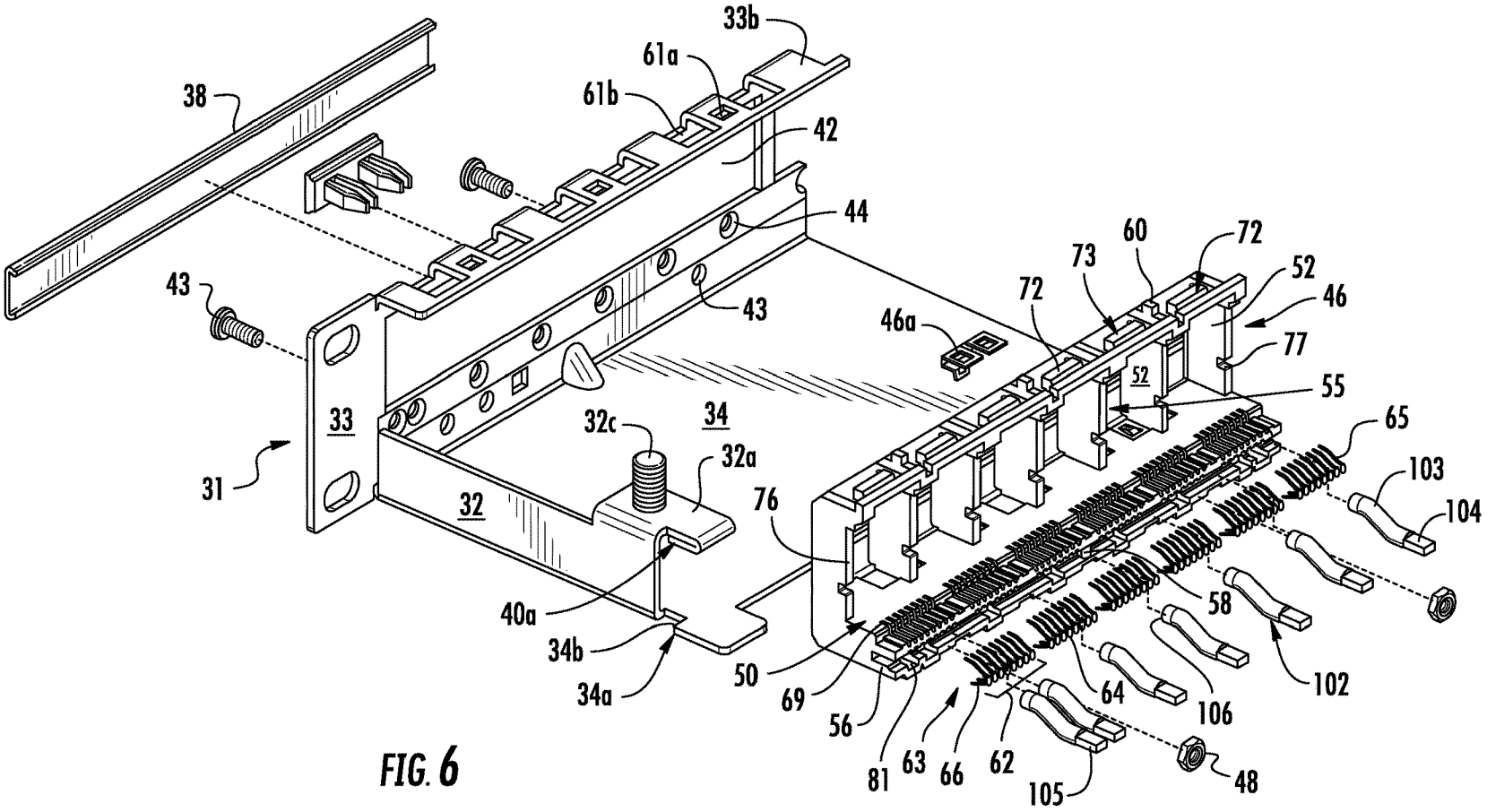
FIG. 6 is an exploded view of the network panel bay of FIG. 5.
Figure 10:
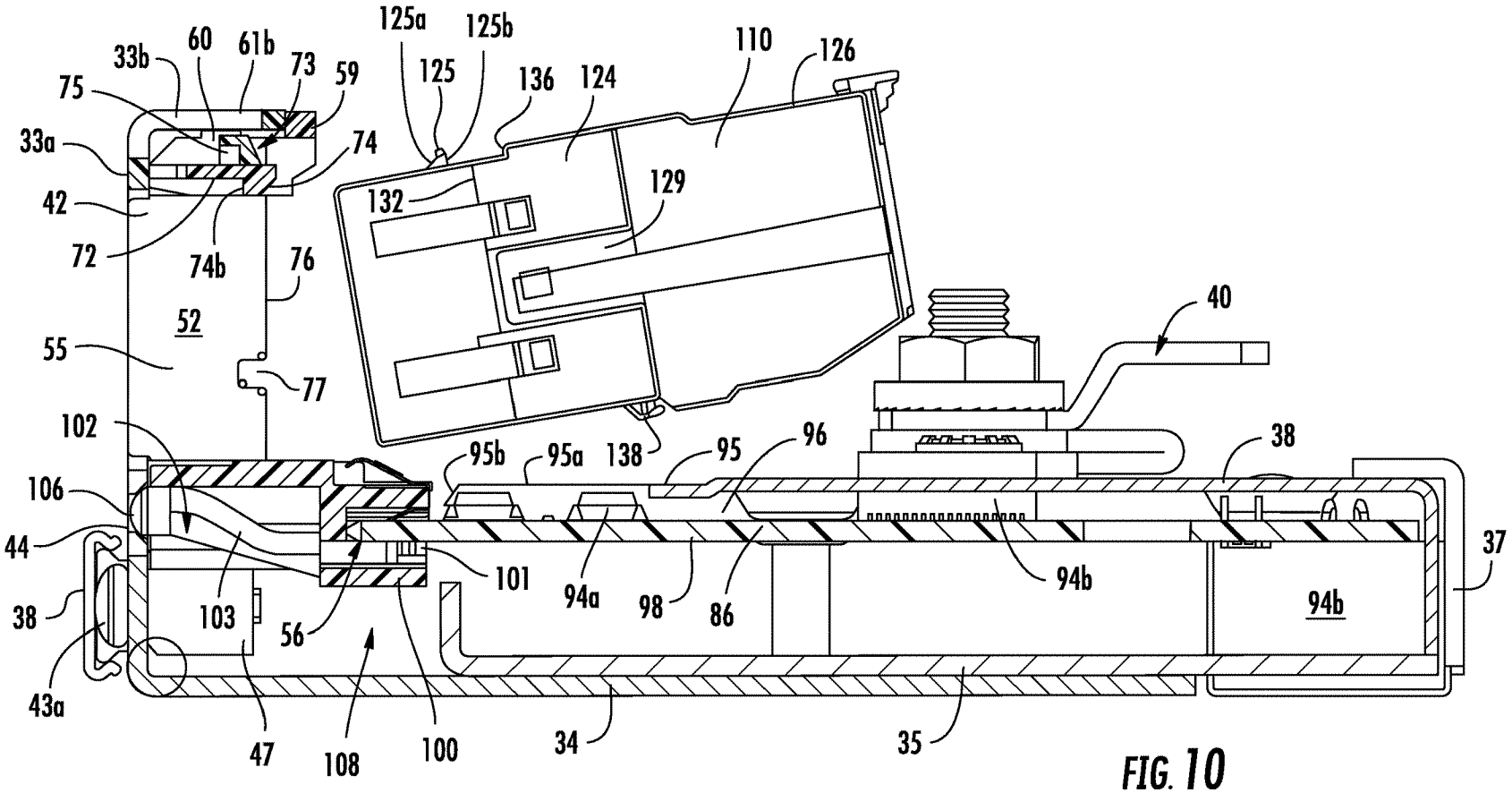
FIG. 10 is a side elevational view of a network panel bay, illustrating how a jack housing is inserted thereinto.
Figure 14:
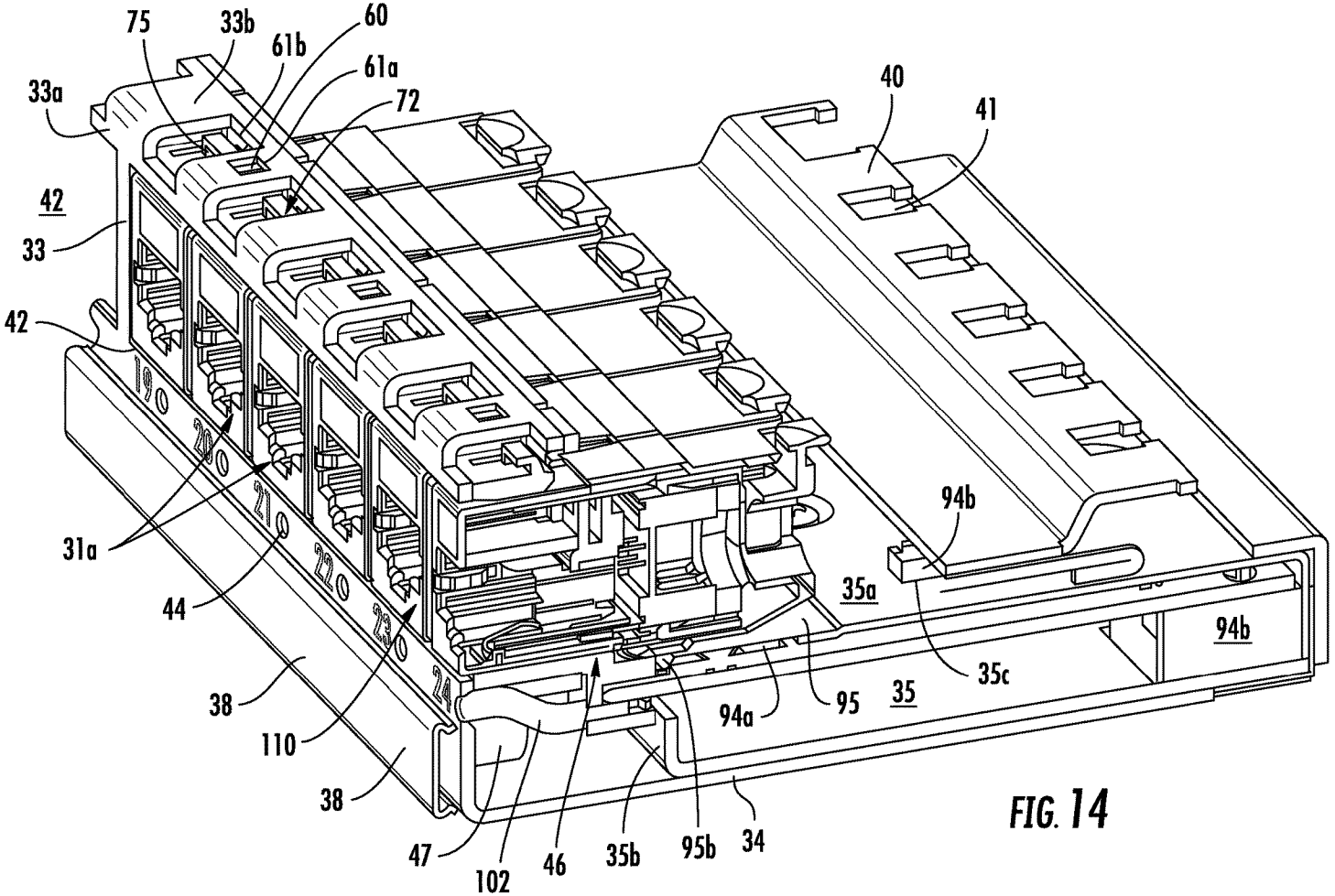
FIG. 14 is a perspective view, taken from above of the network panel bay with its corresponding jacks installed.
Figure 15:
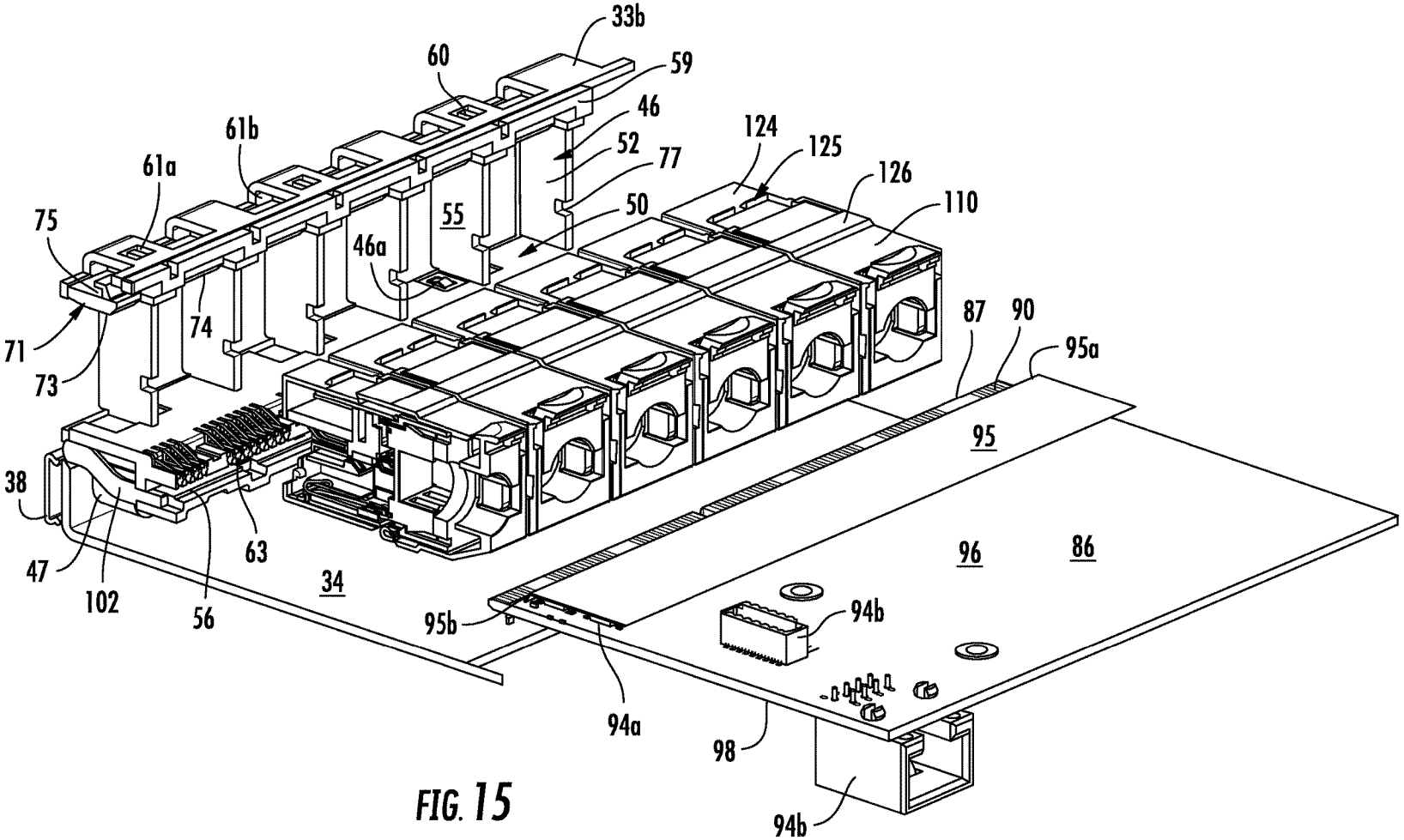
FIG. 15 is a partially exploded view of the network panel bay of FIG. 14.
Figure 22A:
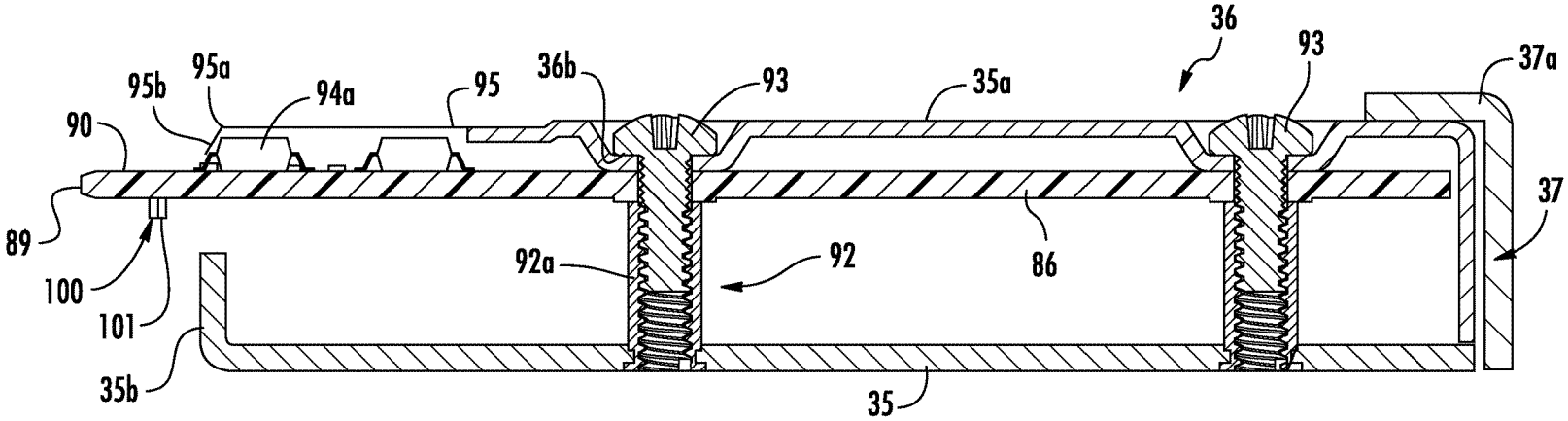
FIG. 22A is a sectional view of a patch panel circuit board module in accordance with the principles of the Present Disclosure.
Figure 24A:
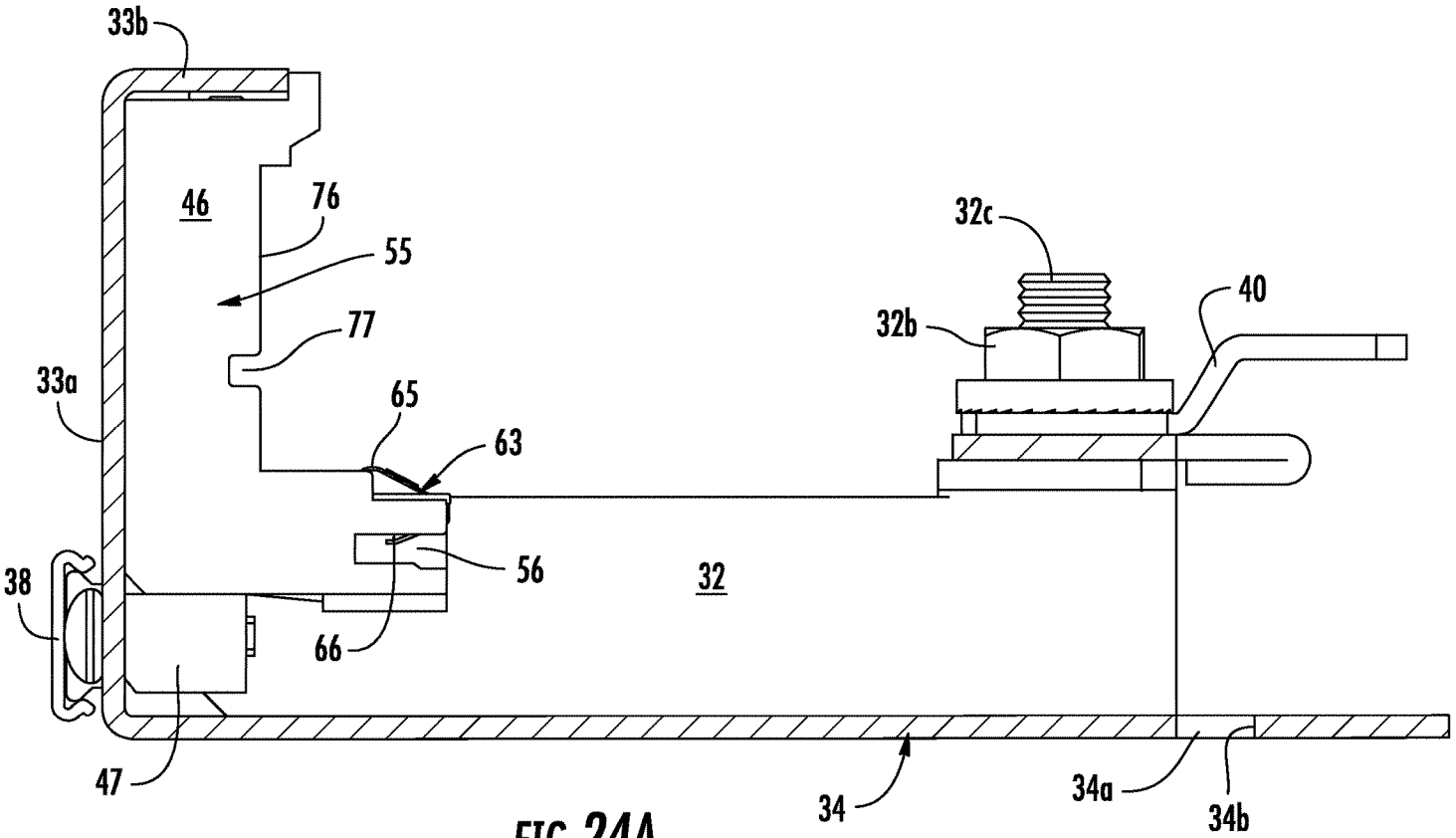
FIG. 24A is a longitudinal sectional view of a patch panel frame and housing assembly.
Figure 24B:
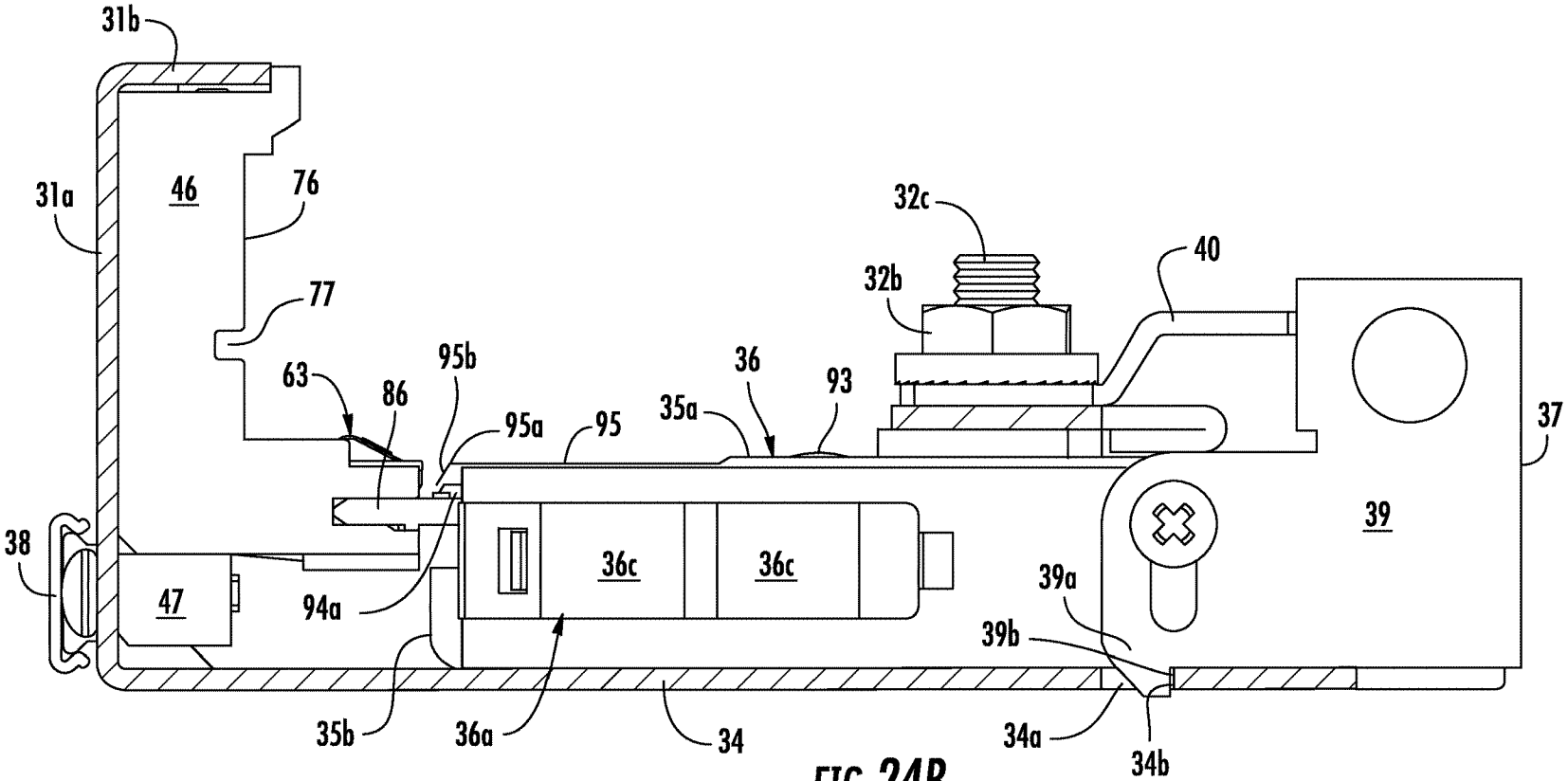
FIG. 24B is the same view as FIG. 24A, but with a circuit board module inserted into the frame nest.
Figure 24C:
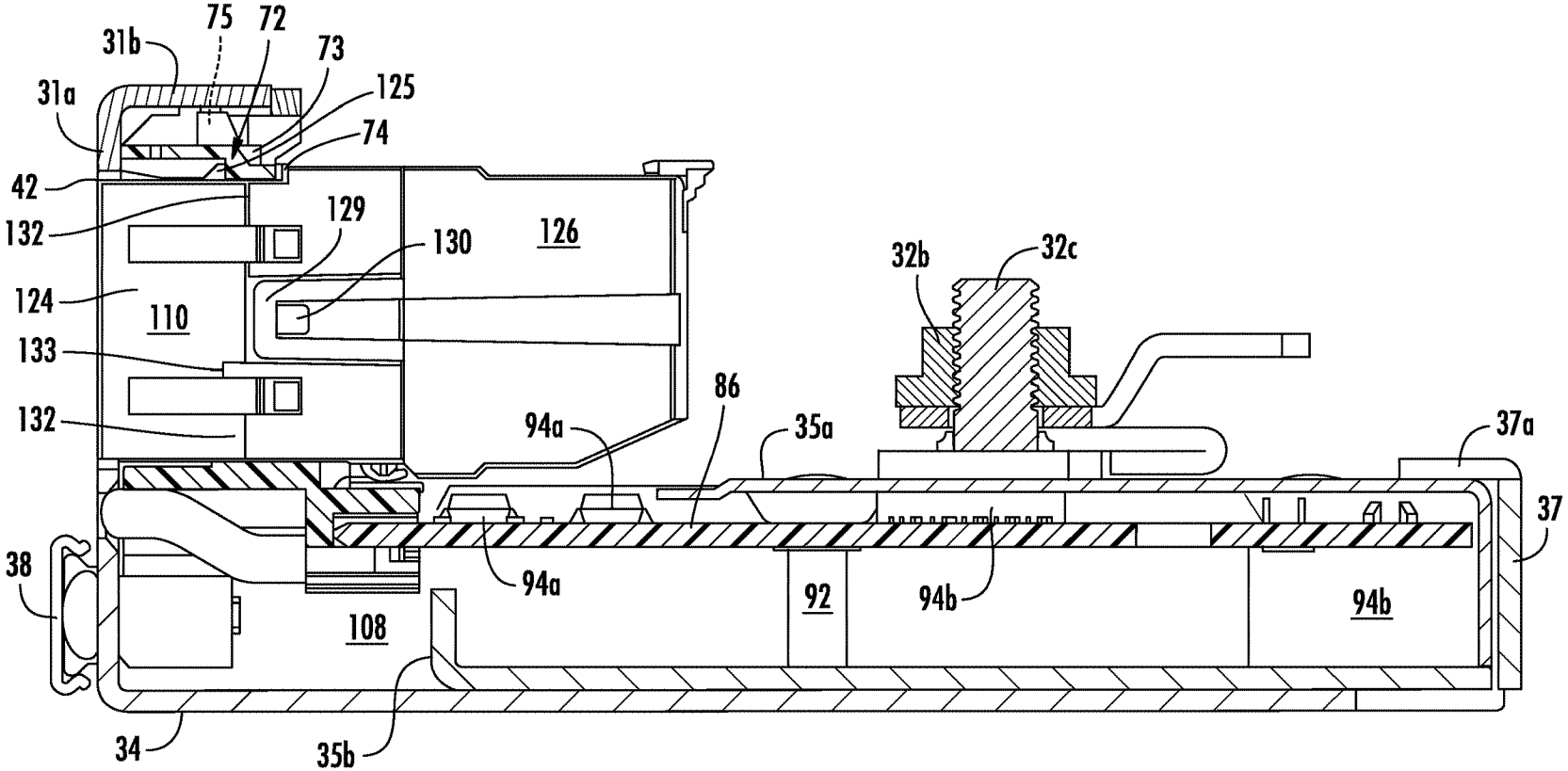
FIG. 24C is the same view as FIG. 24B, but with a jack in place within the frame and portions of the circuit board module shown in phantom.

Due to the differences on lengths of the circuit board 86 and the top and bottom covers 35, 35*a*, the metal cover plate 35 of the module 36 does not cover all the electronic components 94*a* supported by the circuit board 86, so a protective covering in the form of a Mylar film sheet 95, or a similar film-type covering is provided as a cover as illustrated in FIGS. 14-6. The leading edge 95*a* of the film sheet may be bent downwardly to define a contact flap 95*b* interposed between the electronic components 94*a* of the circuit board 86 and the terminals 63 of the panel housing 46 and so provide a measure of insulation against unintended shorting (FIGS. 10-1 and 24C). The bottom cover plate 35 may include, as shown in FIGS. 22A and 24C', an upturned stop surface 35*b* which prevents overtravel of the module 36 during insertion. It is formed by bending the front portion of the bottom cover 35 upwardly in order to confront opposing surfaces of the insulative portions of the panel housings 46. The height of these stop surfaces 35*b* is chosen to engage (if over-inserted) the insulative body portions of the panel housings 46 rather than contact the conductive terminals 63 supported on the housings 46.

Figure 7:
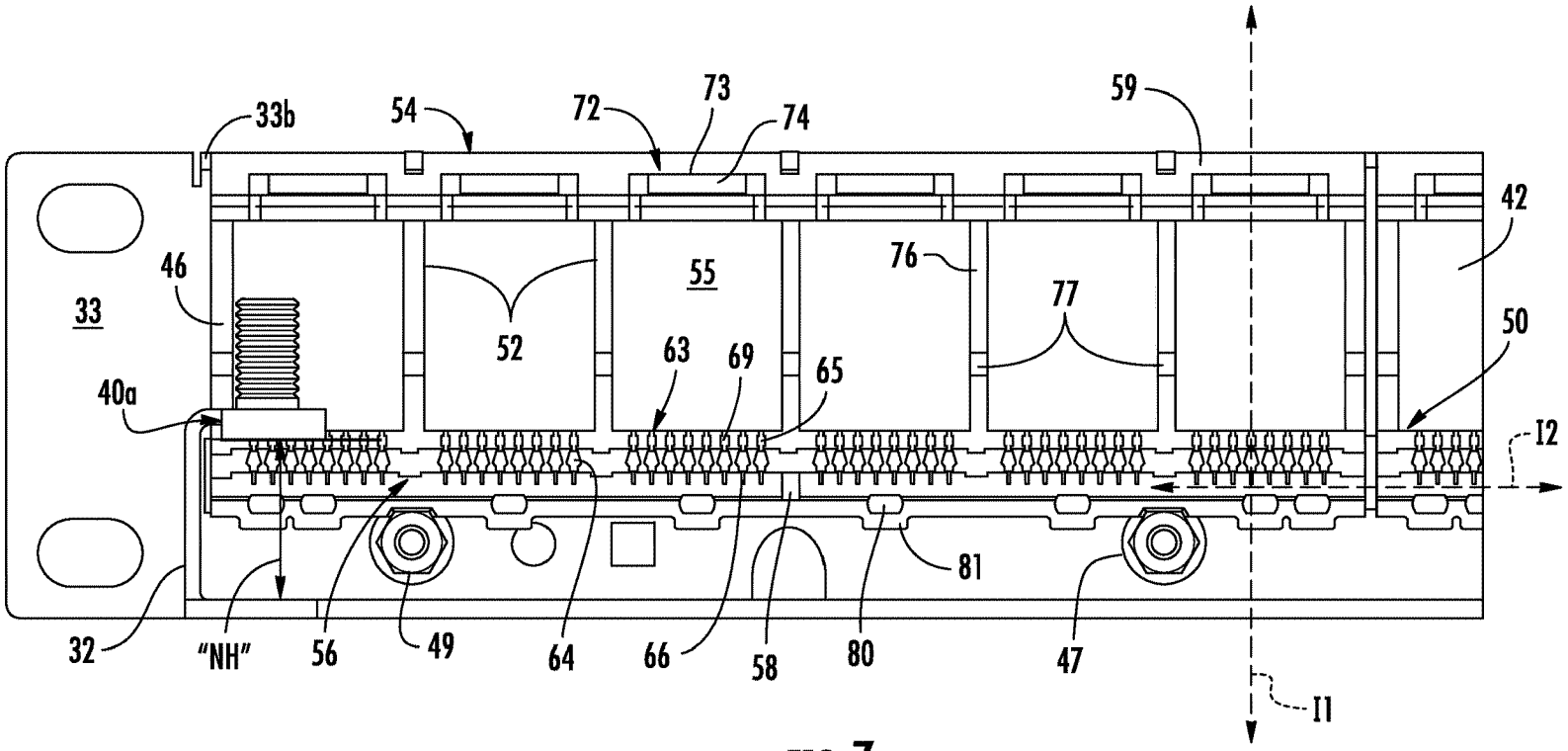
FIG. 7 is a rear elevational view of the network panel bay of FIG. 5, taken along Line 7-7 thereof.
Figure 8:
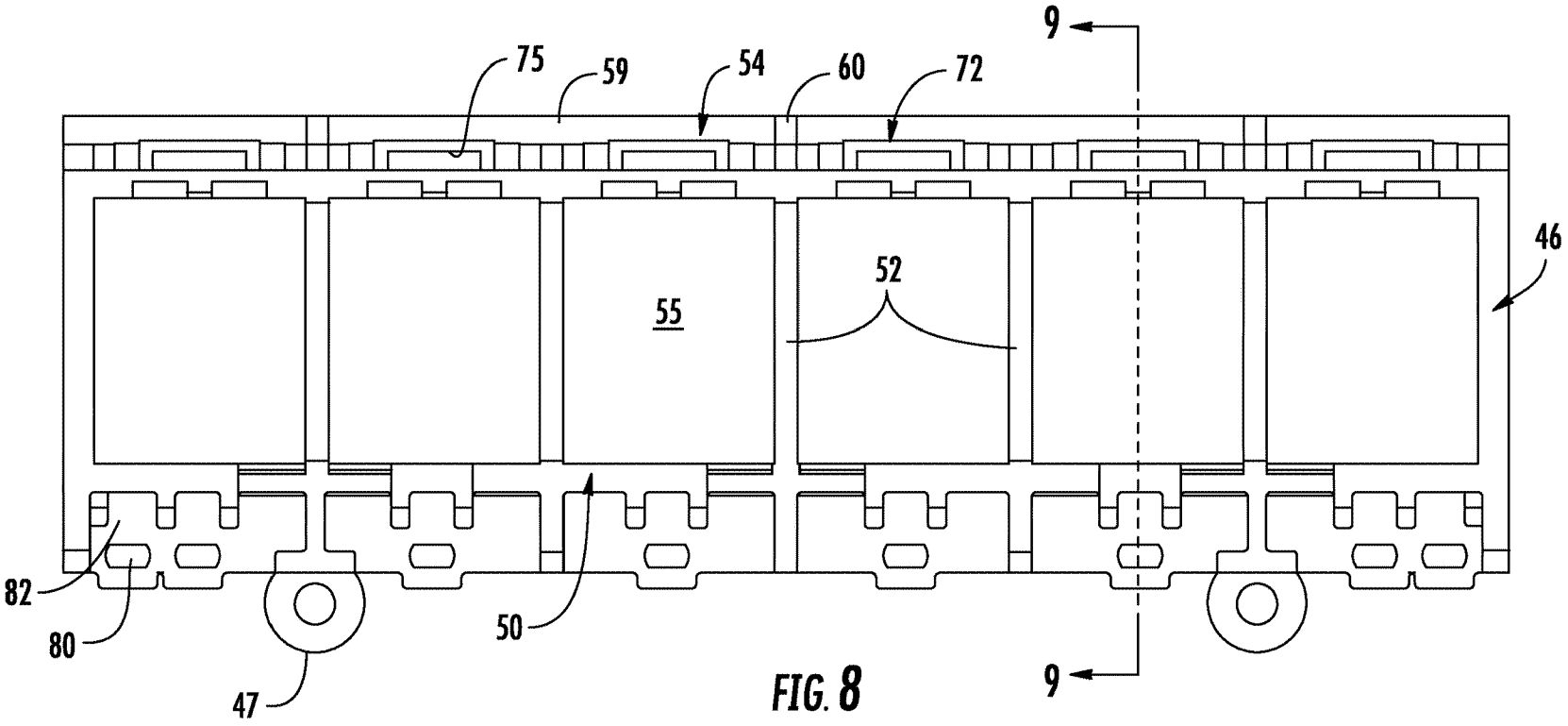
FIG. 8 is a front elevational view of the bezel member of the network panel bay of FIG. 5.

The cable manager 40 is offset in the vertical direction to define a working space behind it and underneath the slots 41 thereof for cables to run, widthwise. The cable manager 40 is further spaced a preselected height above the panel frame base plate 34 to define a nest 108 within the panel frame 32 that accommodates the module 36. This nest also includes the vertical distance NH between the top surface of the panel frame base plate 35 and the bottoms of the jacks 110 and the bottom of the cable manager support base 40*a* (FIG. 7). This distance is greater than the height of the circuit board modules 36 and thereby permits the modules 36 to be inserted and removed from the patch panel 31 without interfering or disturbing any of the jacks 110 or any part of the patch panel frame 32. The module 36 fits into the panel frame nest 108 in a sliding manner sliding upon the panel frame base plate 34. The module 36 also preferably includes means by which to engage the panel frame and as shown in the Figures, may include engagement ends 39 which may be integrally formed as side ends of the end cap 37 of the module 36. These engagement ends 39 include hooks 39*a* defined therein which are oriented lengthwise. They are disposed in opposition to corresponding opposing slots 34*a* formed in the panel frame base plate 34. The hooks 39*a* have planar stop surfaces 39*b* that engage confronting stop surfaces 34*b* of the base plate openings 34*a*.

Figure 23:
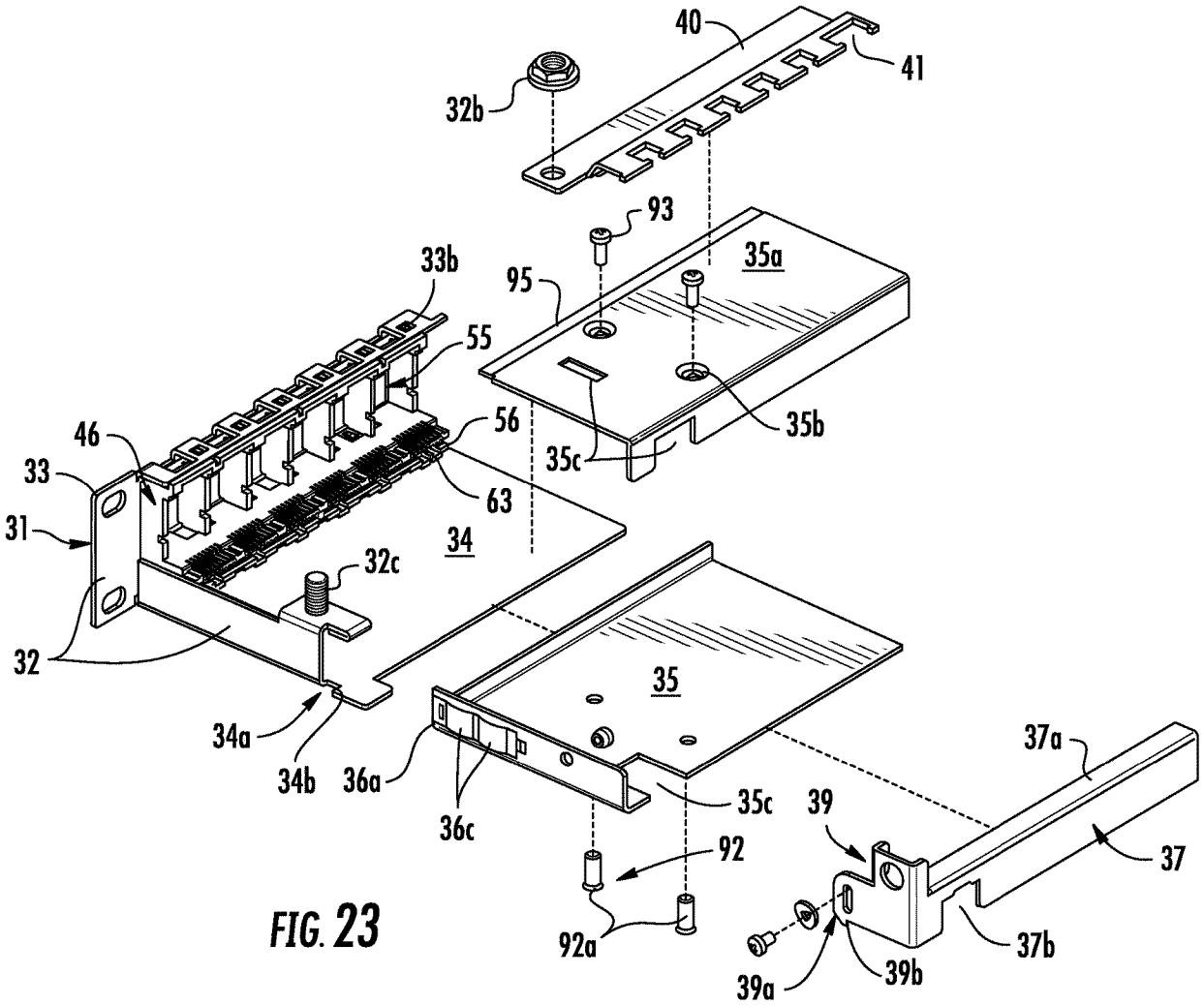
FIG. 23 is an exploded view of the circuit board module aligned with a patch panel frame with a housing mounted therein.

In order to provide grounding contact, the circuit board modules 36 are also provided with grounding springs 36*a* that extend lengthwise along the side walls of the panel frame 32. As illustrated in FIG. 23, the grounding springs 36*a* are elongated and extend lengthwise. They include two portions 36*c* that bow outwardly and make contact with the panel frame 32 inside walls. These grounding springs 36*a* will also make contact with each other as between adjacent modules 36. The modules 36 may have side walls along opposite sides thereof as illustrated in FIGS. 1-2 and the rear end caps 37, associated end caps 37*a* and cable managers 40 extend between the sides. The right side walls, with reference looking forwardly, are not shown in FIGS. 3, 5-6, 11, 22A and 23 for clarity.

The panel frame 32, as shown best in FIG. 2, includes a plurality of openings, shown as rectangular slots 42, which extend widthwise within the face plate 33. These slots are configured to accommodate one or more housings 46, which serve to divide the openings 42 into distinct sets of individual patch panel ports 31*a*, each of which is configured to receive the plug end of a network cable (not shown). In this regard, the housings 46 may be particularly provided in sizes that define N number of patch panel ports, where N can typically be chosen from the group of 1, 2, 3, 4, 6, 8, 12 or 24. These numbers divide evenly into the standard number of ports in a patch panel, namely twenty-four. As such, if the patch panel face plate 33 is provided with four slot openings 42, the housings 46 that mate with the openings 42 will contain six first openings 55 that will form ports 31*a* in each slot opening 42. Likewise, six slot openings 42 will accommodate four first openings 55 in each housing 46.

The face plate 33 may further include a plurality of other ancillary openings, with one type of opening 43 accommodating mounting screws 43*a* that extend through the face plate and which are received in complementary screw openings formed in the housings 46. Other types of openings 44 may be dedicated as indicator openings which accommodate the output ends of light pipes 102 that display an indication of the status of the port 31*a* and/or a data transmission channel of the network. Other openings may be present that engage clips which hold a cover plate 38 in place over the housing screws. The face plate top retainer bar 33*b* extends back from the top of the face plate 33 and includes different openings 61*a*, 61*b* that will engage different parts of the housings 46 when the panel components are fully assembled.

In order to provide the patch panel assemblies 30 of the Present Disclosure with a measure of modularity, which reduces the time for paneling, repairing and assembling patch panels of the Present Disclosure, the face plate slots 42 have predetermined widths which accommodate a preselected number N of ports 31*a* of the patch panel 31. Housings 46 are provided which engage these slots 42 and the housings 46 not only serve to subdivide the face panel slots 42 into individual patch panel ports 31*a*, but also provide a structure which accommodates and interconnects the jacks 110 and circuit boards 86 used in the patch panel assemblies 30 together.

Every housing 46 has a body portion 50, preferably formed from an insulative material. The housing body portion 50 has screw bosses 47 that are threaded and which permit the housing 46 to be attached to the patch panel face plate 33 by way of interengaging screws 48 and nuts 49. A plurality of vertical side walls 52 are supported on the housing body portion 50 and cooperatively define a plurality of hollow, first openings 55 which are configured to receive data jacks 110 therein. A top cross bar 54 extends widthwise and engages portions of the face plate retainer bar 54. Second openings 56 are provided in the housing 46 which accommodate the leading edges 87 of an associated circuit board 86. These second openings 56, as illustrated, extend for the most part horizontally as compared to the vertical directions in which the first openings 55 extend. If imaginary lines 11, 12, were drawn through the centers of the first and second openings, they would intersect each other as illustrated in FIG. 7. The jack openings 55 are aligned along a first common axis A1 which may be taken through the centers thereof, while the circuit board openings 56 may be aligned along a second common axis A2 which is also preferably taken through the centers thereof. These two axes are preferably parallel to the frame base plate 34.

Figure 5:
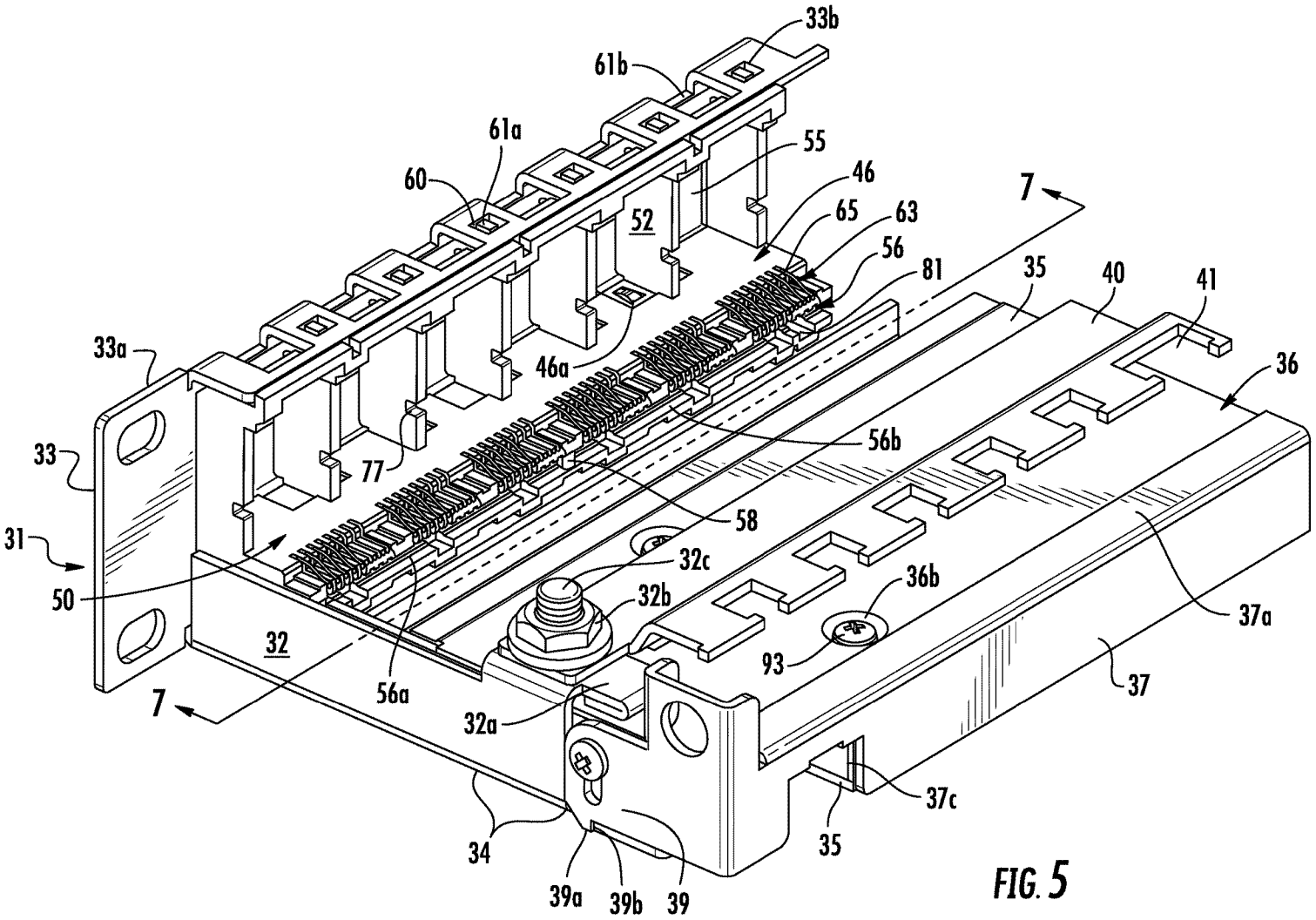
FIG. 5 is a perspective view, taken from the rear, of the network panel bay of FIG. 3, but with the jacks removed for clarity.

The second openings 56 may be subdivided into pairs of openings 56*a*, 56*b* by means of a divider 58. This divider 58 takes the form of an upright wall and confronts a slot 91 formed in the circuit board mating blade 89 to thereby provide a polarization aspect to the housing and circuit board combination so that a circuit board 86 may be inserted into the second openings 56 in only one (and correct) way. As shown in FIG. 5, grounding clips 46*a* may be provided for the patch panel housings 46 that extend into the first openings 55 of the housings to establish redundant grounding contact between the panel frame 32, the face plate 33 and the jacks 110.

The cross bar 54 of the face plate 33 includes different sets of openings 61, with one set, shown as square openings 61*a*, being configured to receive positioning studs 60 formed on the housing top bar 54. Other, rectangular openings 61*b* extend in an axial direction (front to back) in order to accommodate latch members 72 of the housing 46. The latch members 72 are cantilevered in their structure to define free ends 73, and they are shown as extending rearwardly in the embodiments discussed herein. If desired, the latch members 72 may be fashioned to extend forwardly. The cantilevered structure of the latch members provides them with sufficient flexibility to selectively engage and disengage the jacks 110. The latch members 72 extend axially within these other openings 61*b* so that they may be manipulated from either the front of back of the patch panel face plate 33 in order to disengage them from the jacks 110.

Figure 9:
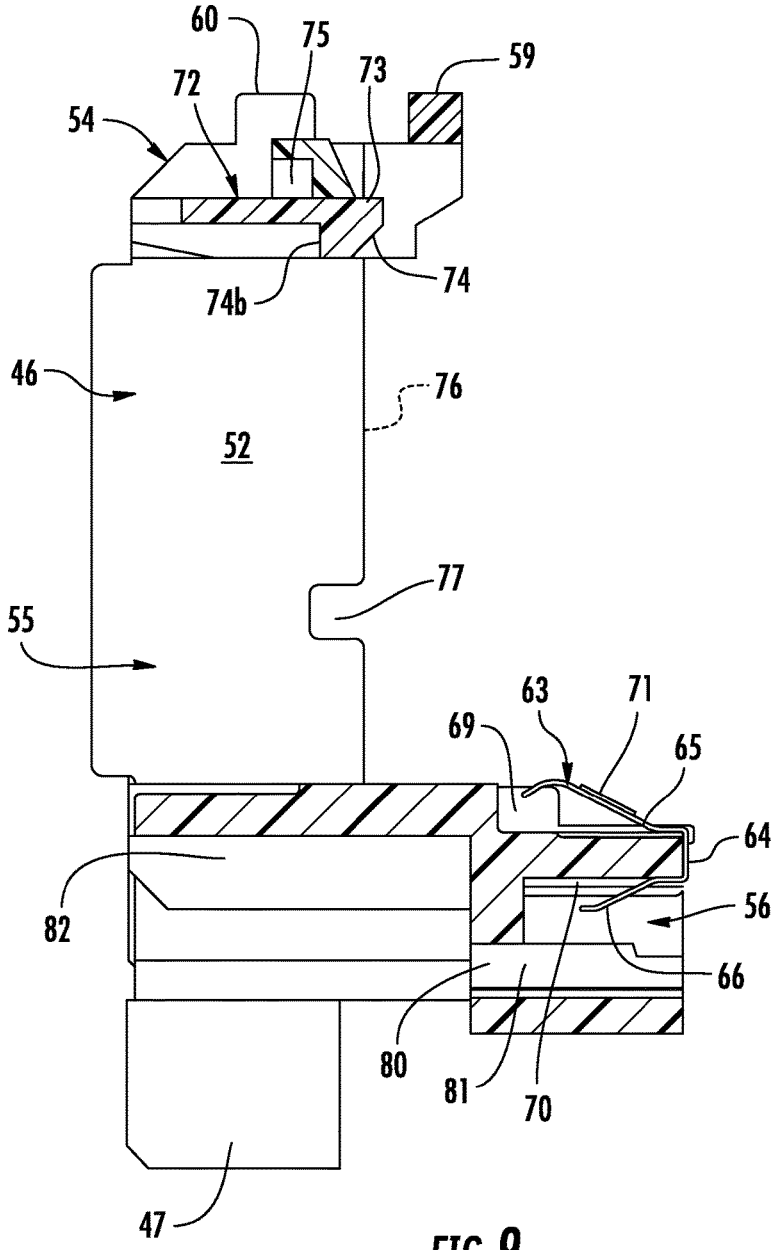
FIG. 9 is a sectional view of the bezel member of FIG. 8, taken along Line 9-9 thereof.

The latch member free ends 73, as shown in FIGS. 9-10, have angled surfaces 74*a* that permit the latch members 72 to slide up and catches 125 which are preferably formed as part of the front cover 124 of the jack 110 and which are disposed on the top surface of the jack 110. These catches 125 also have angled surfaces 125*a* as their front surfaces which facilitate the lifting of the latch member free ends 73 over the catches 125. The catches 125 further include rear stop surfaces 125*b* that are preferably planar surfaces that extend vertically. These rear stop surfaces 125*b* confront and engage the planar, hook surfaces 74*b* of the latch member free ends 74 to prevent the jacks 110 from falling out of their position within and engagement with the housings 46. The front faces of the latch members 72 may include a slot 75 or similarly configured element that permits a user to insert a tool, such as a screwdriver, into the patch panel retainer bar other openings 61*b* and engage the latch member 72. In this manner, the user can lift the latch member 72 up so that the hook surface 74*b* disengages the jack catches 125 and the jacks 110 may be withdrawn from the housing first openings 55.

Although the jack catch-latch member hook surface combination provides sufficient retention of the jacks 110 in place in the housing 46, in order to provide additional securement, the housing 46 may further include slots 77 that extend horizontally and which are disposed in the sidewalls 52 of the housing 46. These side wall slots 77 are configured to accommodate opposing locating ribs 133 that are disposed on the sides of the jacks 110 and which are illustrated as projecting outwardly from the jack front cover 124. The interengaging slot 77-locating ribs 133 combination provide a measure of retention to each jack to keep it in engagement with its housing openings 55. Additional structural features of the housings 46 that provide means for locating the jacks 110 in place within the housing 46 include shoulders 76 on the rear surfaces of the housing sidewalls 52. These shoulders 76 confront and engage opposing, vertical stop shoulders 132 that are disposed on the jack front covers 124.

In order to seat the housings 46 in a preferred orientation within the patch panel slots 42, the housing 46 may include an upraised edge 59 which may either be continuous for the width of the housings 46, or, as illustrated, it may have a discontinuous configuration. The edge 59 bears against the rear edge of the top bar 33*b* of the panel face plate 33. The housing top edge 59 is also preferably spaced apart from the studs 60 of the housing and the latch members 72 so as to hold, preferably in an interference fit, the end of the face plate retainer bar 33*b* therebetween. This fit is illustrated at least in FIGS. 10 and 14-5.

In an important aspect of the Present Disclosure, the housings 46 of the patch panel assemblies 30 are provided with a plurality of conductive terminals 63, which are preferably arranged in distinct terminal sets 62, with each terminal set 62 being associated with one of the housing first openings 55. For each set, the terminals 63 include central retention portions 64 which may include engagement barbs that are flanked by first and second terminal tails, 65 and 66, respectively. The tails 65, 66 extend away from opposite ends of the retention portions 64 in a cantilevered fashion ad extend outwardly away therefrom in an angled fashion such that imaginary lines drawn through the longitudinal axes of the terminal tails 65, 66 will intersect at a location rearwardly of the retention portions 64. In order to provide improved contact, the terminal first tails 65 may include different sized contact pads 65*a*.

The terminals 63 are supported by the housings 46 so that they are interposed between circuit in the data jacks 110 and circuits on the circuit board 86. The terminals serve to provide an electrical connection between exterior terminals 138 of the jacks 110 and contact pads 90 of the circuit boards 86. Due to their cantilever and overall bowed configuration, the terminals 63 are in effect, preloaded with a spring force so that they will resist any vertical forces applied to them and ensure reliable contact between the terminals 63 and the opposing elements. In this regard, and as illustrated in FIGS. 10, 13 and 15-7, the terminal first tails 65 are aligned with respective housing first openings 55 and the terminal second tails 66 are aligned with the housing second openings 56 and further extend into the second openings 56.

The terminals 63 are positioned on the housing 46 firstly in an arrangement so that the second terminal tails 66 extend into the housing second opening 56 and align with corresponding contact pads 90 that are disposed on the top surfaces 96 of the circuit board 86 and which are disposed along the leading edges 87 thereof. The contact pads 90 are further arranged on the mating blades 89 of the circuit board 86, which may be separated from each other by the circuit board leading edge locating slot 91 that engages the housing second opening dividing wall 58. The terminal second tails 66 are preferable curved and the free ends thereof point generally forwardly so that the circuit board contact pads 90 will encounter the contact areas of the second tails 66, particularly the curved contact portions thereof when the mating blades 89 or leading edges 87 of the circuit board is fully inserted into the second openings 56.

The terminal first tails 65 are formed with a similar configuration and include an elongated curved tail portion with a free end that extends forwardly toward the housing first opening 55. The curved portions of these first tails 65 may include, as illustrated, a series of contact portions 65*a* that have a width which is wider than most of the first tails 65. These curved contact portions 65*a* are positioned on the housing 46 in opposition to the exterior terminals 138 of the jacks 110. Their cantilevered structure permits them to flex under contact with the jacks 110 when the jacks are inserted into the housing first openings 55. In order to permit the terminal first tails 65 to fully flex under the pressure of the jacks 110, the housing body portions 50 preferably include longitudinal slots 53 disposed therein in alignment with the first terminals 65. These slots 53 receive the free ends of the terminal first tails 65, which deflect downwardly toward the terminal second ends 66 when the jacks 110 are inserted into the housing first openings. In this manner, the terminals 63 are held in the housing 46, which serves as both a support for the jacks 110 and circuit boards 86 and an interposer connector that electrically connects them together.

Figure 4:
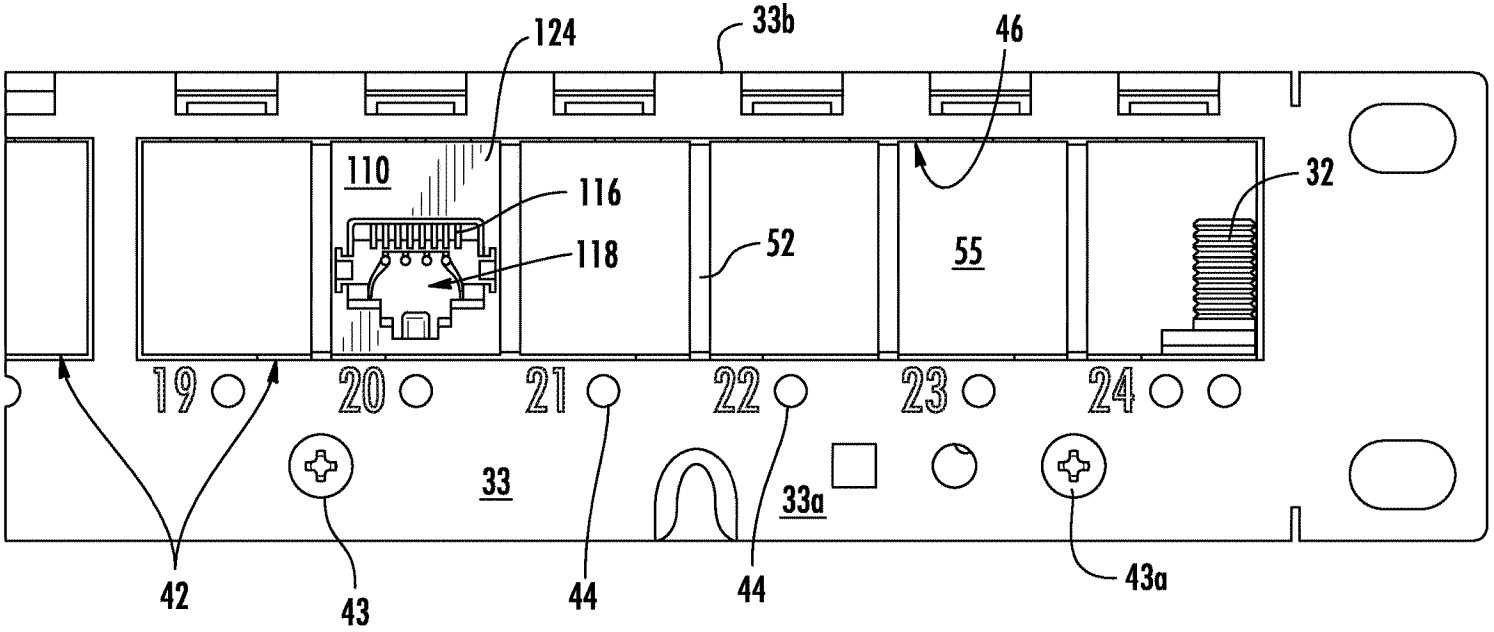
FIG. 4 is a front elevational view of the network panel of FIG. 3.

Patch panels often include light pipes for operational status information associated with their ports 31*a*. The circuit boards 86 utilized in the Present Disclosure have on their bottom surfaces 98, LEDs 100 mounted in supports 101 that support at a preselected level with respect to the circuit board bottom surfaces 98. The LEDs 100 and the light-emitting surfaces thereof are oriented with respect to the circuit board 86 and forwardly with respect to the patch panel 31. The housings 46 may be configured as shown best in FIGS. 10 and 13-4, to support a plurality of light pipes 102 in a preselected association with the ports 31*a* of the patch panel 31.

The light pipes 102, as illustrated, have an offset and somewhat S-shaped configuration that extends between two ends, one end being an input end 105 which confronts, and preferably abuts the display faces 100*a* of the LEDs 100, and the other end being an output end 106. As noted above, the circuit boards 86 are supported in their modules 36 at a level so that the LEDs 100 thereof will abut the light pipe input ends 105 when the circuit board modules 36 are inserted into the panel frame nest 108. The output ends 106 extend into respective associated indicator openings 44 that are disposed in the patch panel face plate 33 in association with a patch panel port. The output end 106 can then communicate with the exterior of the patch panel 30 to identify to an installer, user, technician or the like, operational status, for example.

Figure 13:
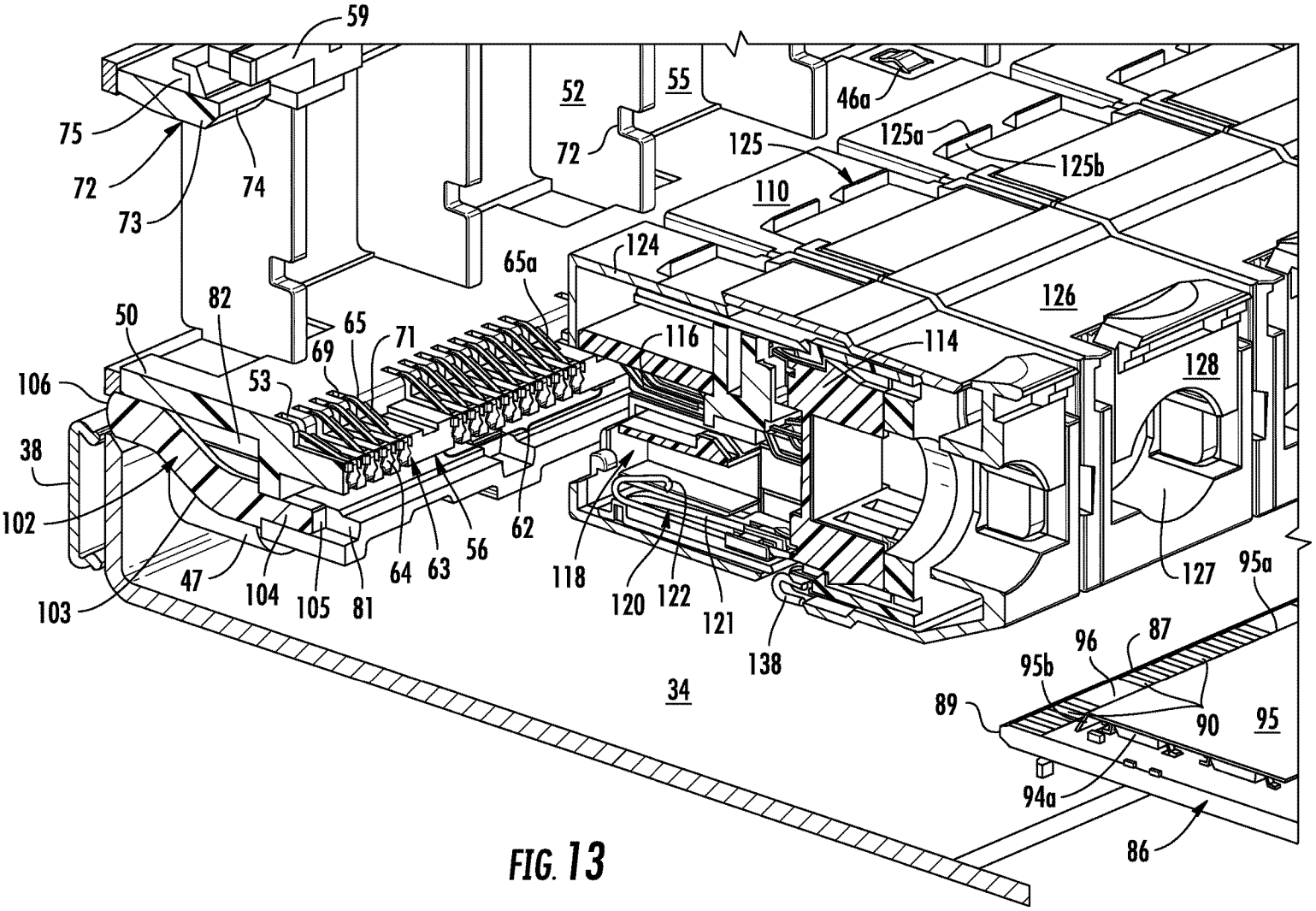
FIG. 13 is an enlarged, detailed sectional view of a network panel bay illustrating a group of data jacks aligned for insertion into a corresponding housing member and further illustrating the housing interposed terminals that connect terminals of the jacks to contacts on the circuit board.

The offset configuration of the light pipes 102 enable the input ends 105 thereof to be positioned within the patch panel assemblies 30 at a location below the level of the output ends 106. The housings 46 include individual channels 80 that are disposed in the body portions 50 thereof, and as illustrated in FIG. 13, the channels 80 may include a rear half 81 in the form of a tail slot, which is shown as a rectangular or square portion, that communicates with the second openings 56 of the housing 46. The channels 80 further include a front half 82, which also may take the form of square or rectangular channels in which the S-bend portions of the light pipes 102 extend. Although not shown, the housing body portions 50 may include depressions formed in the bottom surfaces 50*a* of the body portions 50 that engage portions of the outer surfaces of the light pipes 102.

The rear portions of the light pipes 102 that form the input ends 105 of the light pipes are square or rectangular in configuration which matches that of the channels rear halves 81, while the light pipe front portions that define the light pipe output ends 106 are generally cylindrical in configuration, particularly to fit into the face plate indicator openings 44. The LEDs 100 and their supports 101 depend downwardly from the bottom surfaces 98 of the circuit boards 86 and are preferably configured to fit in at least a portion of the rear channel halves 81. In this manner, the LEDs 100 may be placed into confronting and preferably abutting contact with the light pipe input ends 105. The light pipes 102 may illuminate and thereupon indicate the status of individual ports 31*a*, such as by color, or operation of the ports 31*a* in transmitting data.

It can be seen that the housings 46 serve to divide the patch panel assembly 30 and its associated face plate openings 42 into discrete groups of ports 31*a*, where each such port includes a jack opening of a housing, a data jack 110 inserted therein and a cable terminated to the jack. The number of ports 31*a* defined by each housing 46 can be chosen by the designer. As noted above, the number of ports 31*a* associated with each of the housings 46 in a patch panel assembly of the Present Disclosure will be chosen from the group of 1, 2, 3, 4, 6, 8, 12 or 24. This variety gives the end user the ability to utilize high-speed and low-speed ports in the same patch panel. It further increases the efficiency of repair, replacement or upgrading of the electronics associated with particular ports, or groups of ports 31*a*. Still further it permits an end user the ability to easily build his network, by equipping patch panels with only the housings to define all of the ports, but purchasing and installing an initial number of jacks and associated circuit board or boards with which to start. Then the end user may add additional circuit boards and jacks to second, third and subsequent housing. This saves on initial start-up costs.

Likewise, patch panels of the Present Disclosure may be upgraded in such a step-wise fashion. The patch panels of the '707 Patent described above, required time consuming removal of the two circuit boards for upgrading, repair and replacement, resulting in serious downtime of the patch panel. Patch panel assemblies of the Present Disclosure eliminate this disadvantage. The jacks 110 of the Present Disclosure are also uniquely insertable and removable so that if repair, replacement or upgrading of the jacks must occur, it can be done to the jacks individually, without necessitating the removal of the circuit boards of any of the components associated therewith.

Turning now to FIGS. 13 and 17-22A, a data jack 110 constructed in accordance with the principles of the Present Disclosure is seen to have front and rear interengaging covers 124, 126, respectively, which cooperatively define a jack housing that accommodates the internal structure of the jack 110 and which includes a rear opening 127 that accommodate the termination end of a multi-wire cable (not shown) in the jack housing. The jack front cover 124 includes a pair of catches, or stops 130 that are engaged by elongated hook portions 129 that are formed as part of the jack rear cover 126. As noted above, the jack 110 includes one or more catches 125 that are disposed on a top surface of the jack 110, and in the drawings, the catches 125 are illustrated in position on the jack front cover 124. A cable clamp 128, which may be spring-biased is mounted within the rear jack cover 126 proximate to the rear opening 127 to hold the cable in place with respect to the jack 110.

Figure 19:
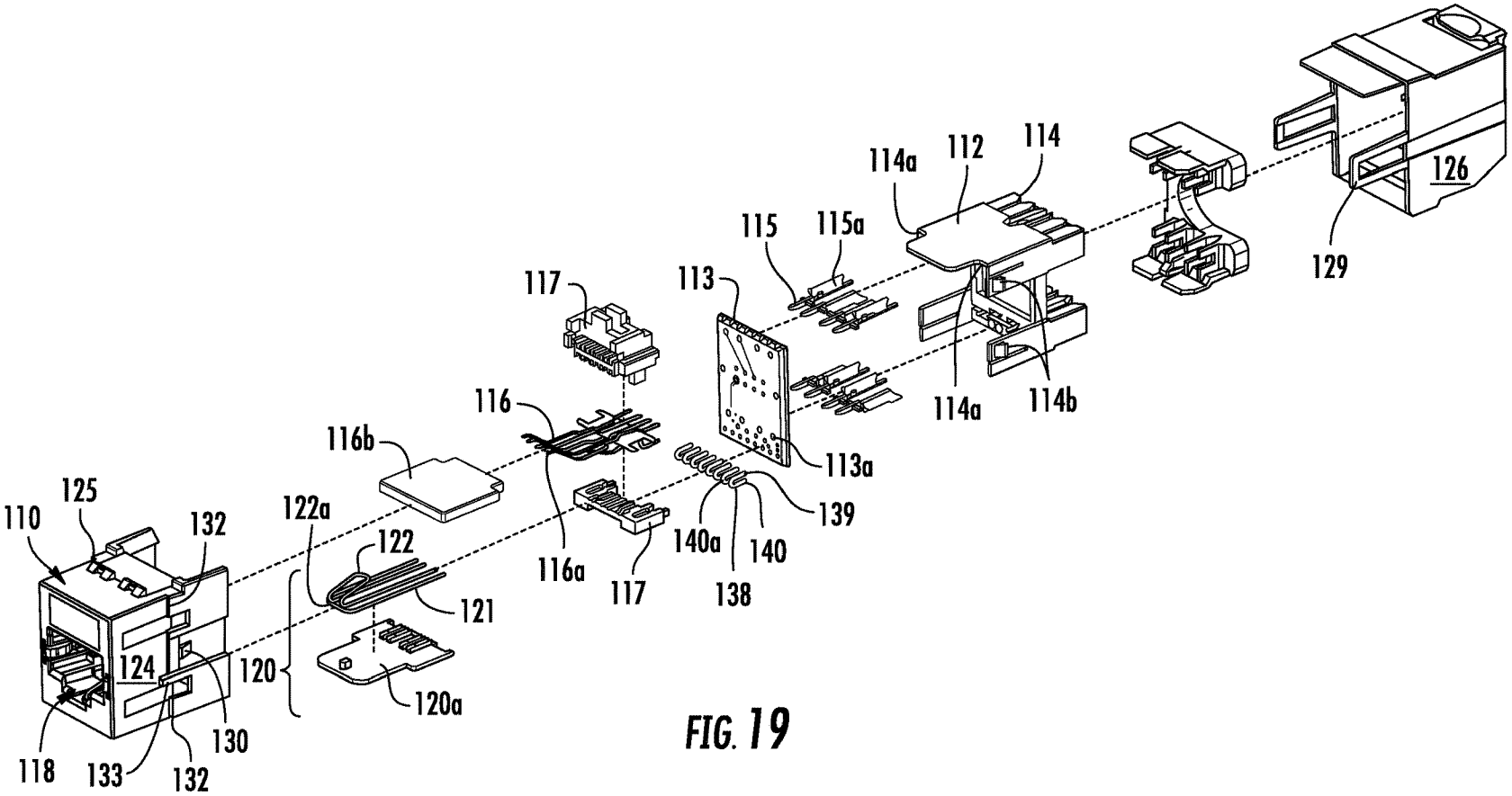
FIG. 19 is an exploded view of the jack of FIG. 18.
Figure 20:
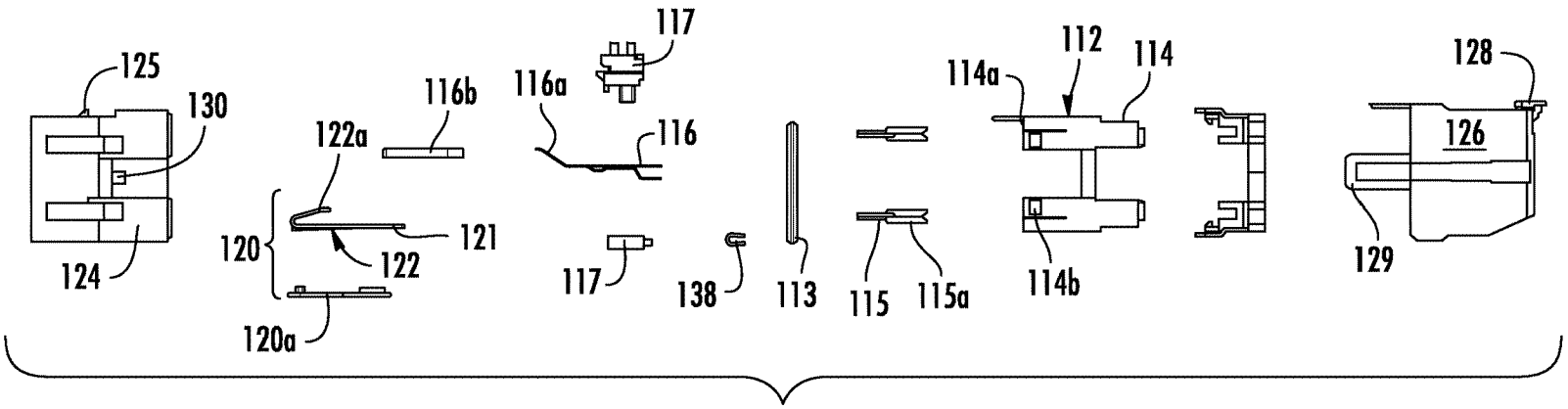
FIG. 20 is a side elevational view of the exploded jack of FIG. 19.
Figure 21A:
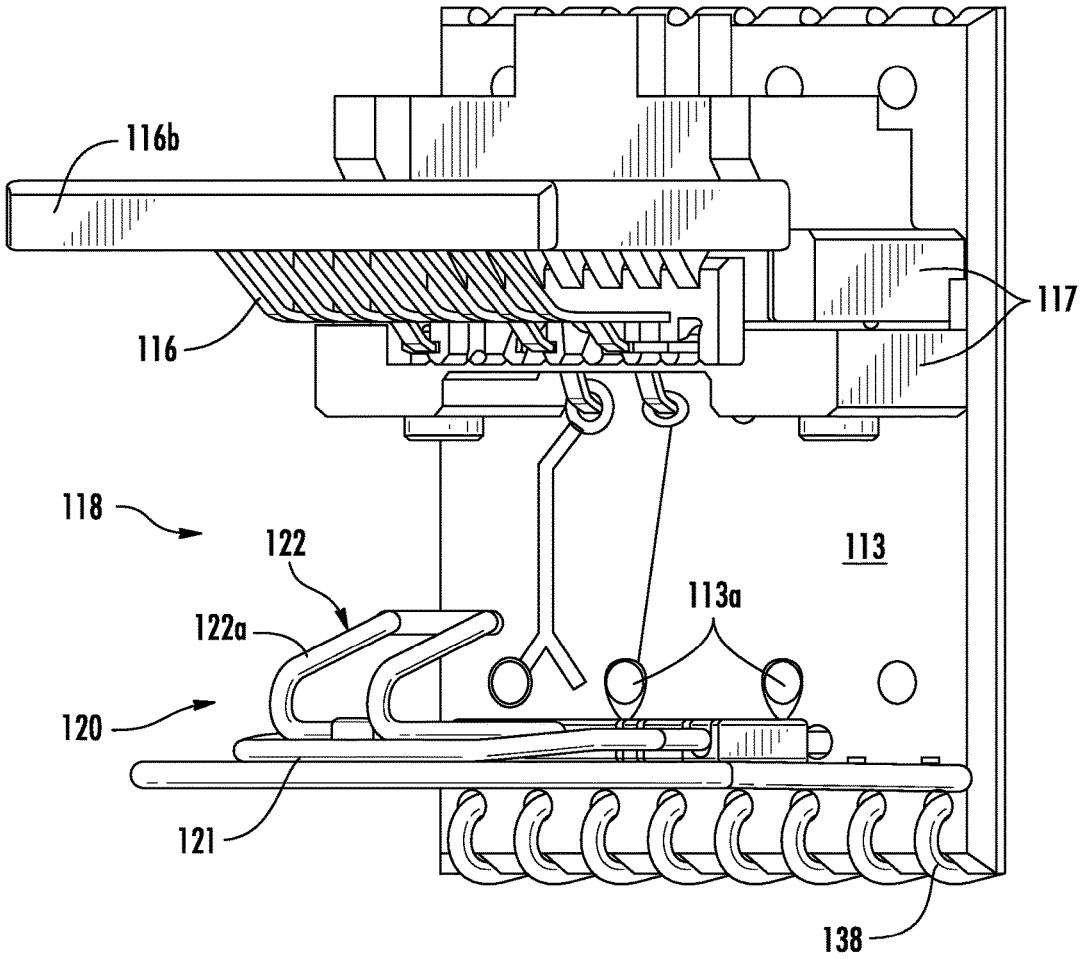
FIG. 21A is a perspective view of the interior assembly of the jack of FIG. 18.
Figure 21B:
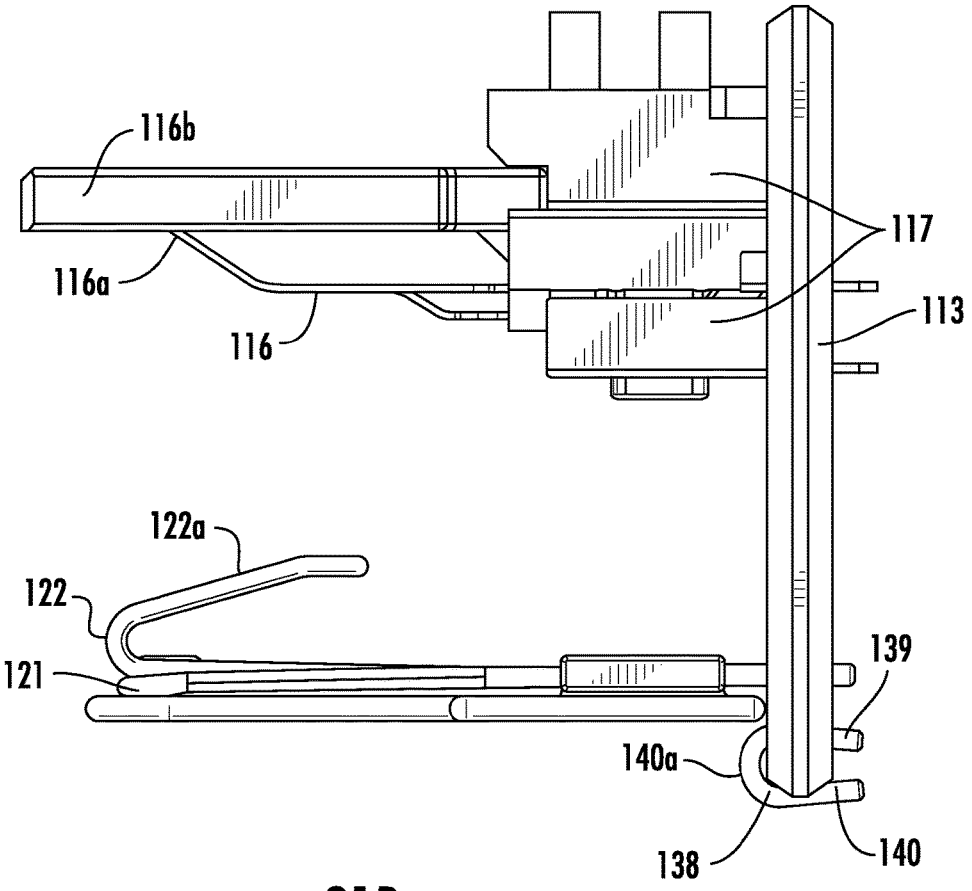
FIG. 21B is a side elevational view of the jack interior assembly of FIG. 21A.

The internal components of the jack are illustrated in FIGS. 19-20 and include an inner frame member 112 that supports a circuit board 113 on one side and a cable wire termination block 114 on the other side of the frame member 112. IDT terminals 115 are supported within the termination block 114 and the IDT terminals 115 includes tail portions 15*a* that contact the inner circuit board 113 by way of a series of vias 113*a*. The IDT terminal contact portions extend longitudinally in the terminal block 114 on opposite sides of wire slots formed therein. The other side of the inner circuit board 113 supports an array of terminals 116 that are partially held in place by a two-piece clam-shell support, shown as a terminal comb 117.

The jack front cover 124 has a central opening that defines a receptacle 118 that is configured to receive a patch panel cable plug therein (not shown) and the jack terminals 116 extend longitudinally within the jack receptacle 118 and the free ends 116*a* thereof are captured within grooves or other openings formed in a positioning support plate 116*b*. The jack terminals 116 are captured, but are free to deflect upwardly and downwardly in a vertical direction under pressure created by the insertion of the cable plug into the receptacle 118. The jack 110 further may include an internal switch assembly 120, illustrated as a horizontal plate 120*a* which supports two terminals 121, 122. The first one 121 of the terminals has a U-shaped configuration that preferably extends in a single plane. The second terminal 122 also has a U-shape but is bent slightly back upon itself so that is extends in two intersecting planes. Both terminals 121, 122 are terminated at their tails to the jack circuit board 113 and both extend longitudinally in the jack receptacle 118. The second terminal 122 is arranged so that it extends within a space bounded by the first terminal 121 and it is slightly angled upwardly with respect to the first terminal 121 so that it is spaced vertically apart from it.

The front end 122*a* of the second terminal 122 is bent backwards at an upward angle as illustrated to present a tang that a cable plug engages when it is inserted into the jack receptacle 118. The cable plug makes contact with the angled front end 122*a* of the second terminal 122 and forces it downward into shorting contact with the first terminal 121. These terminals 121, 122 comprise an internal switch in each jack that can provide a connecting signal to the patch panel electronics, which indicates complete insertion by a cable plug into the jack receptacle 118 as well as indicates a complete connection with the jack terminals 116. If the signal provided by the shorting contact merely indicates that the plug is fully inserted, it informs the installer and/or end user that the patch panel port should be live and producing an operational signal. No signal will indicate that either the cable or the cable plug is bad, while a signal will indicate the cable and its plugs are good. When the assemblies of the Present Disclosure are utilized with shielded modular plugs, the jacks 110 include opposing ground terminals 118*a* that will establish a ground circuit between the opposing plugs and the jack covers 124 allowing for a through ground connection.

Importantly, the jacks 110 of the patch panel assemblies 30 of the Present Disclosure are singular jacks, meaning that they are individual jacks that may be selectively inserted into and removed from the housing first openings 55. As such, they can be terminated to individual associated cables by an installer prior to installation of them into the patch panel frame 32. This is an advantage over a structure similar or identical that described in the '707 Patent, where the jack housings are attached to one surface of one circuit board and the termination blocks are attached to the other surface of the one circuit board. Such a structure will not permit the use of a punch down tool when the jack housing and termination block are mounted to a circuit board. With the structure of the jacks 110 of the Present Disclosure, the termination blocks 114 are held in place within the jack front cover 124 by way of stop surfaces 114*a* that abuttingly engage stop surfaces disposed within the interior of the front jack cover 124. Additionally, the termination blocks 114 may include catches 114*b* that project outwardly and which are received in corresponding openings 125*a* of the jack front cover 125. The catches 114*b* may be depressed inwardly to free them from engagement with the jack front cover 124 so that the interior assembly may be removed.

The termination blocks 114 are therefore held reliably in place within the jack front covers and they extend rearwardly therefrom. An ordinary IDT wire termination tool may be used and because the jack front covers 125 are preferably made from metal, they can define hard reaction surfaces to bear against a termination jig, or tool, during the termination process. There is no worry about damaging the circuit boards 86 as there would be in a structure in accordance with the '707 Patent. In yet another important aspect of the Present Disclosure, the jacks 110 are provided with exterior terminals, or contacts 138, which are configured to contact the housing terminal first tails 65 when the jacks are inserted into the housings 46. These exterior terminals 138 are terminated at their tail portions 139 to the inner circuit board 113 and are connected to the jack terminals 115, 116 by traces disposed on the circuit board 113. The terminals 138 have contact portions 140 at their free ends and the terminal 138 are shown as having an overall C-shape in order to define a curved front portion 140*a* of the terminal contact portions 140. The jack connecting terminals curved front portions 140*a* will contact the housing terminal first tails 65 and they and the free end contact portions 140 will preferably contact the first terminal contact portions 65*a*.

This manner of insertion of a jack 110 into a first opening 55 of a patch panel housing 46 effectively provides a connecting path, via the housing interposed terminals 63, between the jack inner terminals 116 and circuits and electronic elements on a circuit board 86. The cables terminated to the jacks 110 are supported by the cable manager 40 and they may be supported by weaving them in and out of the cable manager slots 41 thereof. The cable manager 40, in its offset configuration maintains the cables at a height above the frame base plate 34 no less than NH in order to provide clearance to the panel frame nest 108 to accommodate the circuit board modules 36 in their movement in and out of engagement with the housing circuit board openings 56.

With the ports of the patch panel assemblies of the Present Disclosure separated into discrete groups, single groups of ports or all of the ports of the patch panel may now be replaced, repaired and/or upgraded without having to take all of the patch panel ports out of operation. The jacks of any single housing may be replaced individually without disturbing the other jacks in that housing or the remaining jacks in the patch panel assembly. Likewise, the circuit board may be removed and replaced, repaired or upgraded individually by pulling it out or inserting it underneath the cable array and associated jacks, without requiring removal of any of the jacks or housings. A single circuit board may be easily replaced with multiple circuit boards, either standing alone or as incorporated into a module type structure as discussed above. The modular ability of the patch panel assemblies can even permit an end user to utilize some of the ports of a patch panel for high-speed applications, while maintaining the remaining ports of the patch panel for low-speed applications, an aspect that was not feasibly accomplished in patch panels of the '707 Patent style.

While a preferred embodiment of the Present Disclosure is shown and described, it is envisioned that those skilled in the art may devise various modifications without departing from the spirit and scope of the foregoing Description and the appended Claims.

What is claimed is:

1. A modular patch panel assembly for a computer network, the assembly comprising:

a panel frame, the panel frame including an associated face plate, the face plate including a plurality of lengthwise slots;

a plurality of housing members, the plurality being no greater in number than a number of face plate slots, each housing member including an array of jack openings, each jack opening receiving a plurality of data jacks therein, each jack opening defining a plurality of individual ports for the computer network, each housing member further including a circuit board opening and an array of conductive terminals, the circuit board opening receiving a mating edge of a circuit board therein, each of the array of conductive terminals being disposed on the housing member and extending between one jack opening and one circuit board opening;

at least two circuit boards, each circuit board including at least one mating blade and contact pads, each mating blade received within one circuit board opening, the contact pads being contacted by tails of the conductive terminals; and a plurality of data jacks, each jack being received within one jack opening, each jack including an outer shell, a plurality of first terminals and a plurality of exterior terminals, the outer shell enclosing a plurality of interior terminals for mating with an opposing plug, each first terminal mating with wires of a network cable, each exterior terminal operatively connecting the interior and first terminals to the conductive terminals, wherein the outer shells are conductive and the exterior terminals are isolated from contact therewith.

2. The patch panel assembly of claim 1, wherein each jack opening includes a latch member, the latch member retaining a single jack therein, each jack further includes at least one catch, each catch disposed on the outer shell of the jack, each catch being engaged by the latch member when said jack is fully inserted into said jack opening.

3. The patch panel assembly of claim 2, wherein the face plate further includes a plurality of longitudinal slots, the latch members extending into the slots, whereby a tool may be inserted into the slots to release the latch members from engagement therewith.

4. The patch panel assembly of claim 1, wherein the first terminals are IDT terminals.

5. The patch panel assembly of claim 1, wherein the conductive terminals include spring ends, the spring ends accommodating dimensional and/or alignment variations in the jacks and the circuit boards.

6. The patch panel assembly of claim 1, wherein the circuit boards may be removed and replaced from the housing members without terminating new cables to the jacks.

7. A modular patch panel assembly for a computer network, the assembly comprising:

a panel frame, the panel frame including an associated face plate, the face plate including a plurality of lengthwise slots;

a plurality of housing members, the plurality being no greater in number than a number of face plate slots, each housing member including an array of jack openings, each jack opening receiving a plurality of data jacks therein, each jack opening defining a plurality of individual ports for the computer network, each housing member further including a circuit board opening and an array of conductive terminals, the circuit board opening receiving a mating edge of a circuit board therein, each of the array of conductive terminals being disposed on the housing member and extending between one jack opening and one circuit board opening;

at least two circuit boards, each circuit board including at least one mating blade and contact pads, each mating blade received within one circuit board opening, the contact pads being contacted by tails of the conductive terminals; and a plurality of data jacks, each jack being received within one jack opening, each jack including an outer shell, a plurality of first terminals and a plurality of exterior terminals, the outer shell enclosing a plurality of interior terminals for mating with an opposing plug, each first terminal mating with wires of a network cable, each exterior terminal operatively connecting the interior and first terminals to the conductive terminals, further including indicator switch assemblies disposed within each jack, the switch assemblies transmitting operational status signals under pressure of the plug, the plug being fully inserted into the jack.

8. The patch panel assembly of claim 7, wherein the first terminals are IDT terminals and portions of the switch assemblies urge the fully-inserted plugs into jack cavities, the jack cavities being disposed against the interior terminals.

* * * * *